US008651035B2

(12) United States Patent
Fukao

(10) Patent No.: US 8,651,035 B2
(45) Date of Patent: Feb. 18, 2014

(54) MULTI-NEEDLE SEWING MACHINE

(75) Inventor: Hiroaki Fukao, Kasugai-shi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1054 days.

(21) Appl. No.: 12/697,856

(22) Filed: Feb. 1, 2010

(65) Prior Publication Data

US 2010/0242819 A1 Sep. 30, 2010

(30) Foreign Application Priority Data

Mar. 24, 2009 (JP) ..... 2009-071927

(51) Int. Cl.
*D05B 1/08* (2006.01)

(52) U.S. Cl.
USPC ..... 112/163

(58) Field of Classification Search
USPC ..... 112/163, 254, 255, 258, 259, 270, 279, 112/302; 242/169, 170, 172, 118
See application file for complete search history.

(56) References Cited

U.S. PATENT DOCUMENTS

| | | | | |
|---|---|---|---|---|
| 1,690,367 | A * | 11/1928 | Gotchette | 242/139 |
| 1,730,431 | A | 10/1929 | Keefer | |
| 2,090,286 | A * | 8/1937 | Chura | 242/139 |
| 2,940,685 | A | 6/1960 | Glass | |
| 4,351,458 | A | 9/1982 | Wolfe | |
| 4,407,461 | A * | 10/1983 | Tomisawa | 242/134 |
| 5,063,866 | A | 11/1991 | Jimenez et al. | |
| 7,114,455 | B2 | 10/2006 | Prufer et al. | |
| 8,251,000 | B2 | 8/2012 | Fukao et al. | |
| 2011/0011318 | A1 | 1/2011 | Fukao | |
| 2011/0011319 | A1 | 1/2011 | Fukao | |

FOREIGN PATENT DOCUMENTS

| | | |
|---|---|---|
| JP | A-56-73765 | 6/1981 |
| JP | U-58-98074 | 7/1983 |

(Continued)

OTHER PUBLICATIONS

Office Action dated Jan. 20, 2012 issued in U.S. Appl. No. 12/830,776.

(Continued)

*Primary Examiner* — Tejash Patel
(74) *Attorney, Agent, or Firm* — Oliff PLC

(57) ABSTRACT

A multi-needle sewing machine includes a machine frame side thread guide member and guide threads drawn from plural thread spools. The multiple-needle sewing machine includes plural thread entrances to introduce threads guided by machine frame side thread guide portions to needle sides of needle bars, plural intermediate thread guide portions that guide intermediate portions of the threads, and an intermediate thread guide portion moving mechanism. The intermediate thread guide portion moving mechanism moves the intermediate thread guide portions in accordance with movements of the thread entrances during a movement of the needle bar case such that the intermediate thread guide portions are moved by maintain that the intermediate thread guide portions are spaced from each other.

6 Claims, 26 Drawing Sheets

(56) References Cited

FOREIGN PATENT DOCUMENTS

| | | |
|---|---|---|
| JP | U-60-27877 | 2/1985 |
| JP | U-60-30779 | 3/1985 |
| JP | U-05-44073 | 8/1993 |
| JP | U-06-036585 | 5/1994 |
| JP | U-6-46676 | 6/1994 |
| JP | A-06-312073 | 11/1994 |
| JP | U-6-81478 | 11/1994 |
| JP | A-08-71278 | 3/1996 |
| JP | A-2000-008265 | 1/2000 |
| JP | A-2000-126487 | 5/2000 |
| JP | A-2000-126488 | 5/2000 |
| JP | A-2004-242980 | 9/2004 |
| JP | A-2004-261413 | 9/2004 |
| JP | A-2006-61179 | 3/2006 |
| JP | A-2006-193240 | 7/2006 |
| JP | U-3138430 | 12/2007 |
| JP | A-2010-220846 | 10/2010 |
| JP | A-2011-19699 | 2/2011 |
| JP | A-2011-19700 | 2/2011 |

OTHER PUBLICATIONS

U.S. Appl. No. 12/830,776, filed Jul. 6, 2010.
U.S. Appl. No. 13/016,352, filed Jan. 28, 2011.
U.S. Appl. No. 12/801,507, filed Jun. 11, 2010.
Mar. 8, 2011 Office Action issued in Japanese Patent Application No. 2009-071927 (with translation).
Apr. 19, 2011 Office Action issued in Japanese Patent Application No. 2009-166770 (with translation).
Japanese Office Action issued in Japanese Patent Application No. 2009-071927 dated Nov. 24, 2010 (with translation).
Dec. 20, 2012 Office Action issued in U.S. Appl. No. 12/801,507.

* cited by examiner

MULTI-NEEDLE SEWING MACHINE

CROSS-REFERENCE TO RELATED APPLICATIONS

This application is based upon and claims the benefit of priority from the prior Japanese Patent Application No. 2009-71927 filed on Mar. 24, 2009, the entire contents of which are incorporated herein by reference.

BACKGROUND

1. Technical Field

The present disclosure relates to a multi-needle sewing machine provided with a needle-bar moving mechanism which moves a needle bar case housing a plurality of needle bars.

2. Description of the Related Art

Multi-needle sewing machines have conventionally been used to sew an embroidery pattern of a plurality of colors. For example, Japanese Utility Model Application Publications, JP-U-H06-46676 (hereinafter referred to as "first document") and JP-U-H06-81478 (hereinafter referred to as "second document") and Japanese Patent Application Publication, JP-A-2006-61179 (hereinafter referred to as "third document") disclose such multi-needle sewing machines respectively. The multi-needle sewing machine is generally provided with needle bar case in which are housed a plurality of needle bars having lower ends to which needles are attached respectively. The needle bar case is moved in a right-left direction so that one of the plural needle bars is selected. Threads are supplied from thread spools to the needles respectively.

The conventional multi-needle sewing machines have a possibility that the movement of the needle bar case may entangle the needles drawn from the plural thread spools with each other or one another. As a countermeasure, the multi-needle embroidery sewing machines disclosed by the respective above-referenced first and second documents employ the construction that the needle bar case and a spool holder on which thread spools are placed are moved synchronously. However, this countermeasure complicates the construction of the multi-needle sewing machine and increases the size of the multi-needle sewing machine. Furthermore, the third document discloses a spool holder device for an embroidery sewing machine, wherein threads are passed through a plurality of elongate tubes respectively so that the threads are prevented from interference with each other or one another. Passing the threads through the respective tubes has a difficulty.

SUMMARY

Therefore, an object of the disclosure is to provide a multi-needle sewing machine which has a simple construction and is compact in size and can prevent thread entanglement without a troublesome work of passing the threads through tubes.

The present disclosure provides a multi-needle sewing machine comprising a plurality of needle bars having lower ends to which needles are attached, respectively; a needle bar case which supports the needles so that the needles are movable upward and downward; a needle bar case moving mechanism which moves the needle bar case so that a predetermined one of the needle bars is moved to a needle position that is a sewing position; a machine frame side thread guide member which is fixed to a machine frame and has a plurality of machine frame side thread guide portions which are arranged at predetermined intervals and guide threads drawn from a plurality of thread spools provided on the machine frame respectively; a plurality of thread entrances which are defined in the needle bar case to introduce the threads guided by the machine frame side thread guide portions to the needle sides of the needle bars, respectively; a plurality of intermediate thread guide portions which are provided between the machine frame side thread guide portions and the thread entrances so as to be movable respectively, the intermediate thread guide portions guiding intermediate portions of the threads extending from the machine frame side thread guide portions toward the thread entrances respectively; and an intermediate thread guide portion moving mechanism which moves the intermediate thread guide portions according to movement of the needle bar case during movement of the thread entrances with movement of the needle bar case while the intermediate thread guide portions are spaced from each other.

BRIEF DESCRIPTION OF THE DRAWINGS

In the accompanying drawings:

FIGS. 29A and 298 are a partial front view and a right side view of the intermediate thread guide portion moving mechanism, showing the multi-needle sewing machine of a fourth example, respectively;

DETAILED DESCRIPTION OF THE DISCLOSURE

First Example

Figure 1:
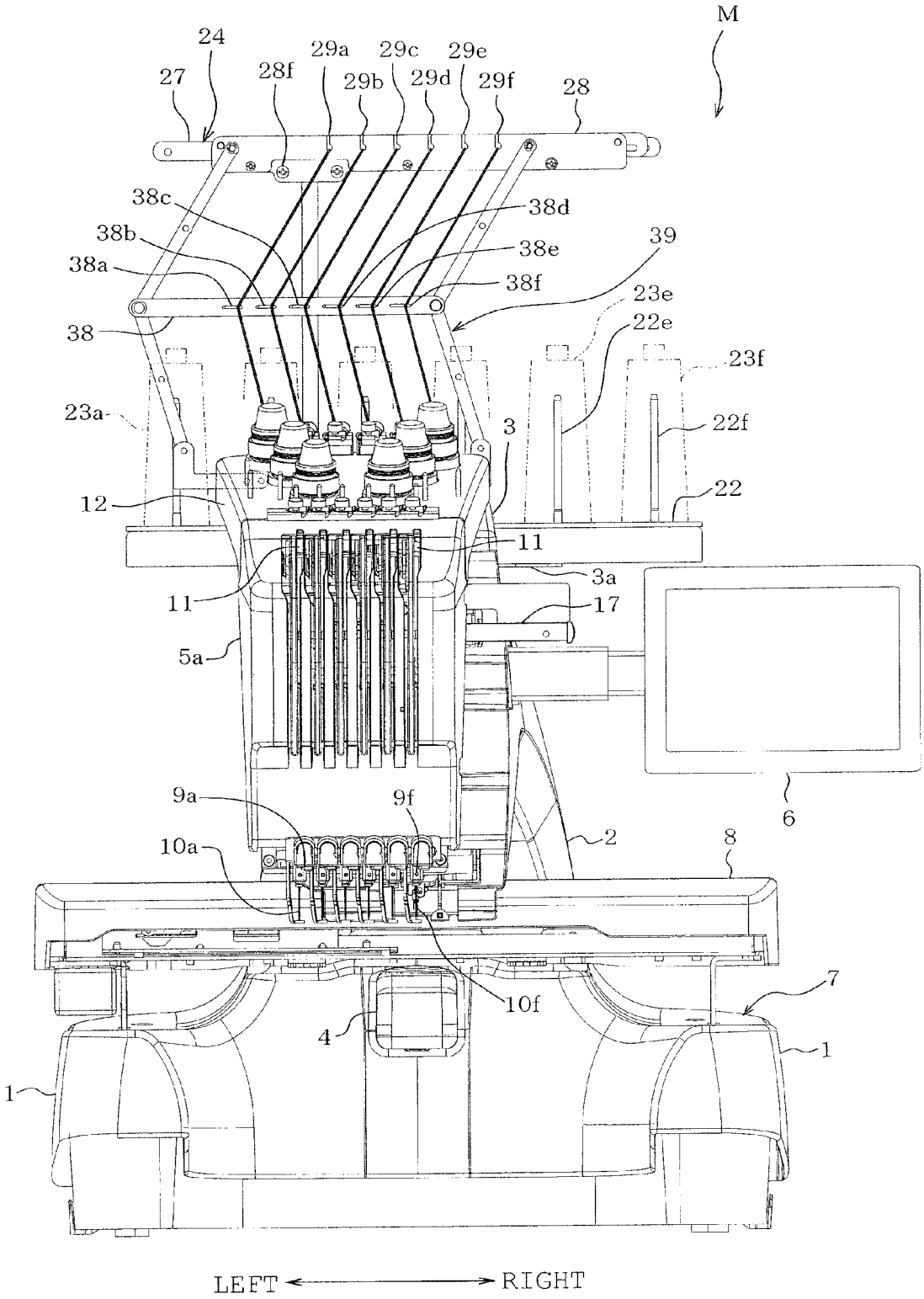
FIG. 1 is a front view of an overall multi-needle sewing machine of one example.
Figure 2:
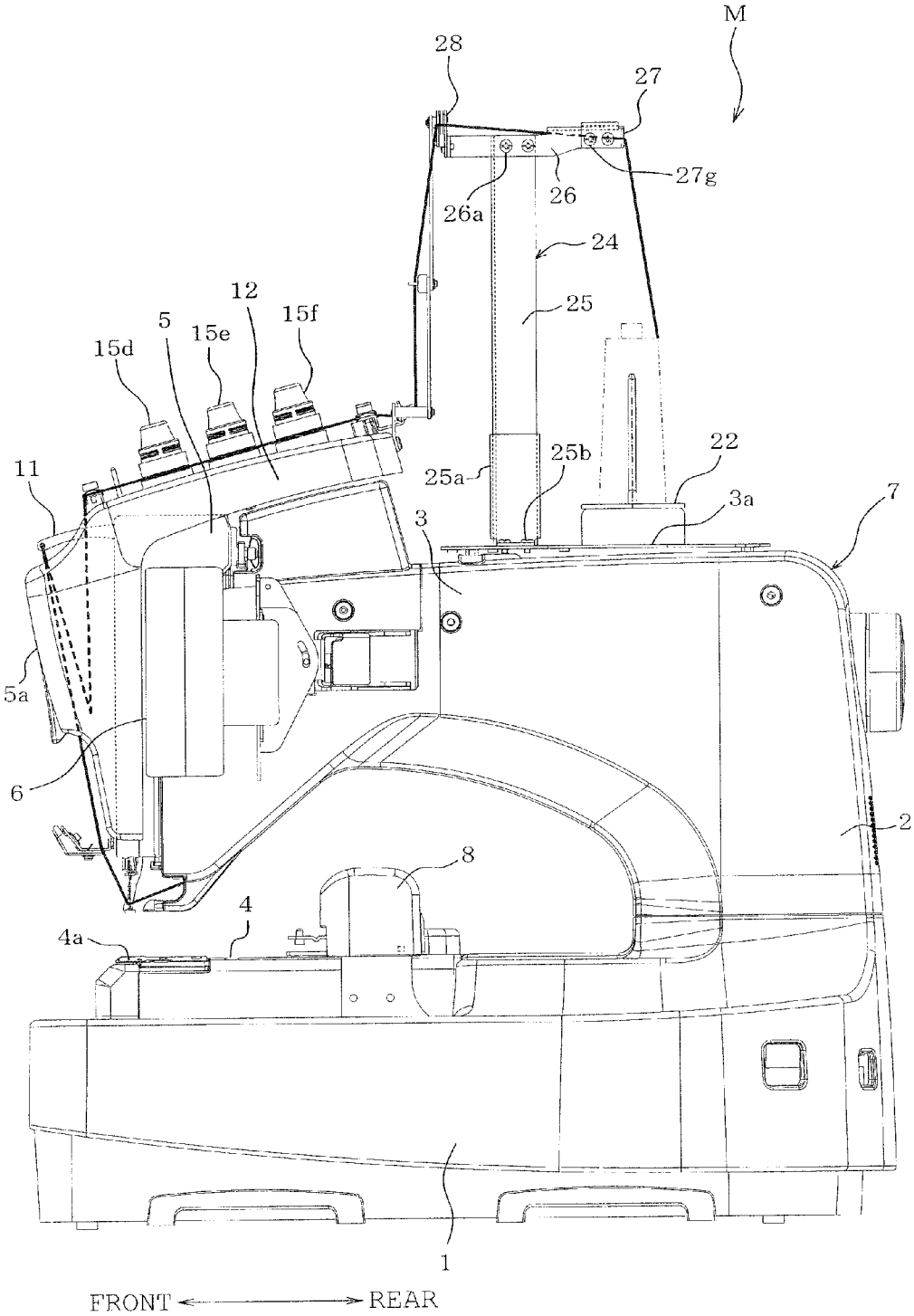
FIG. 2 is a right side view of the multi-needle sewing machine.
Figure 3:
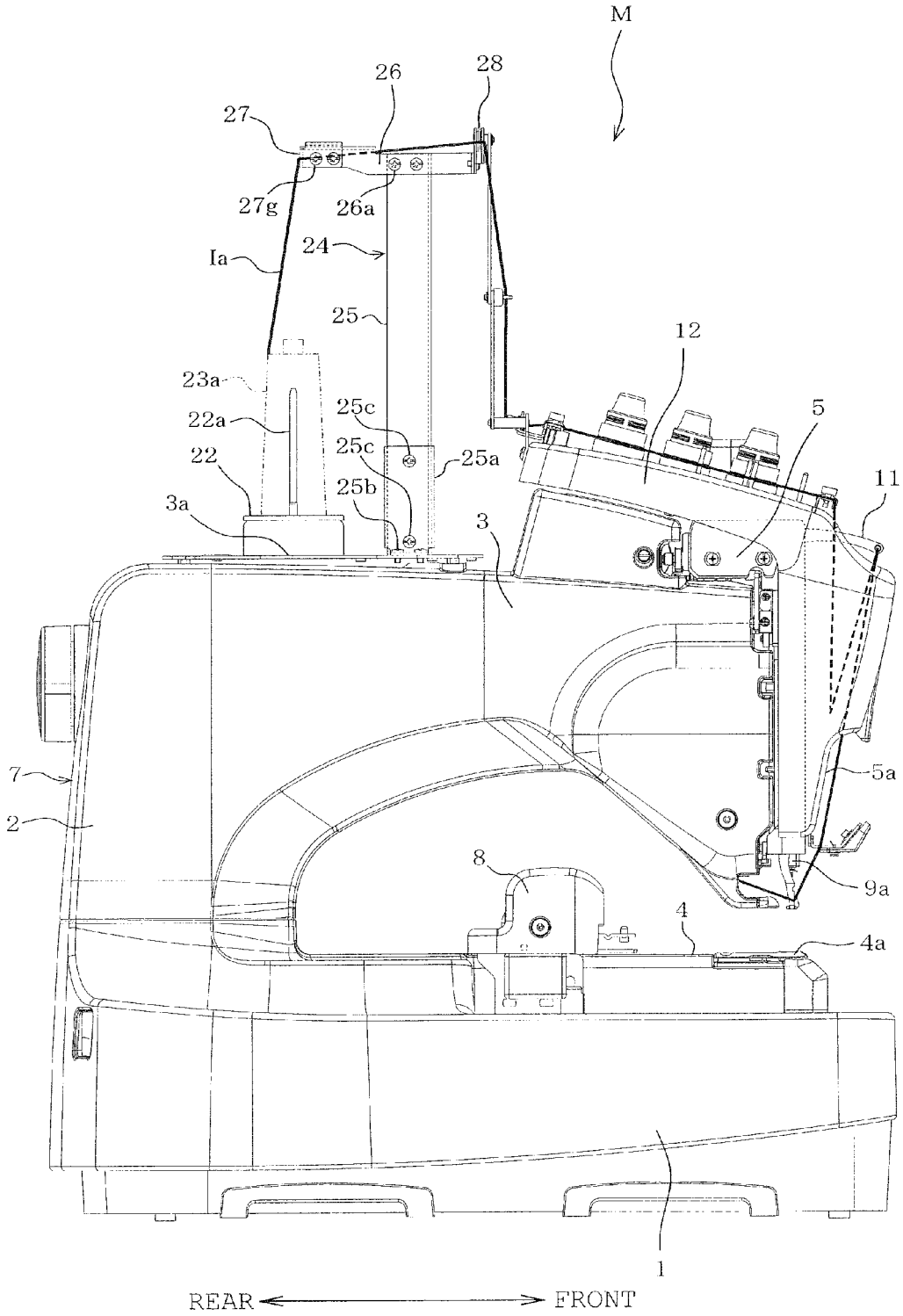
FIG. 3 is a left side view of the multi-needle sewing machine.
Figure 4:
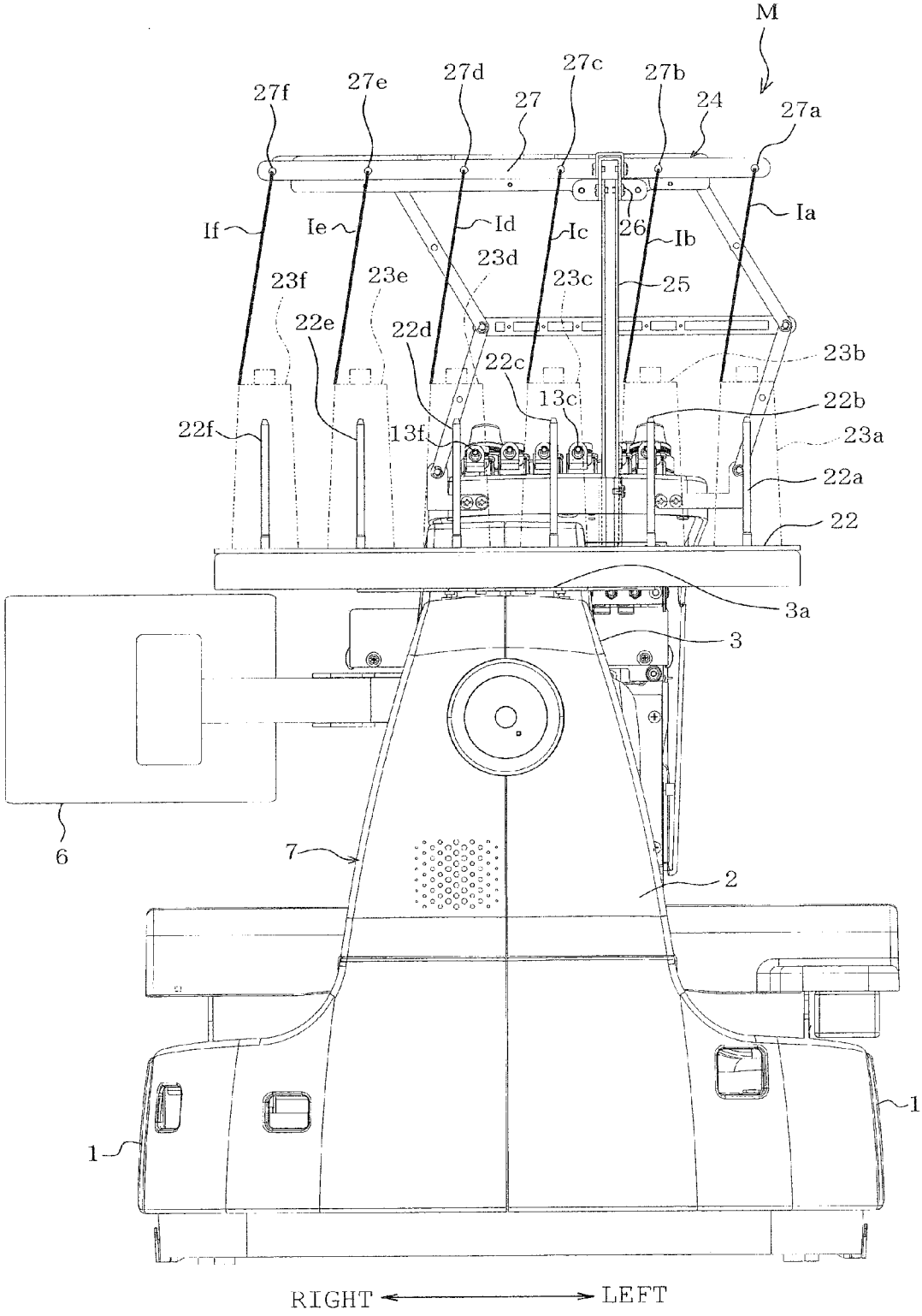
FIG. 4 is a rear view of the multi-needle sewing machine.
Figure 5:
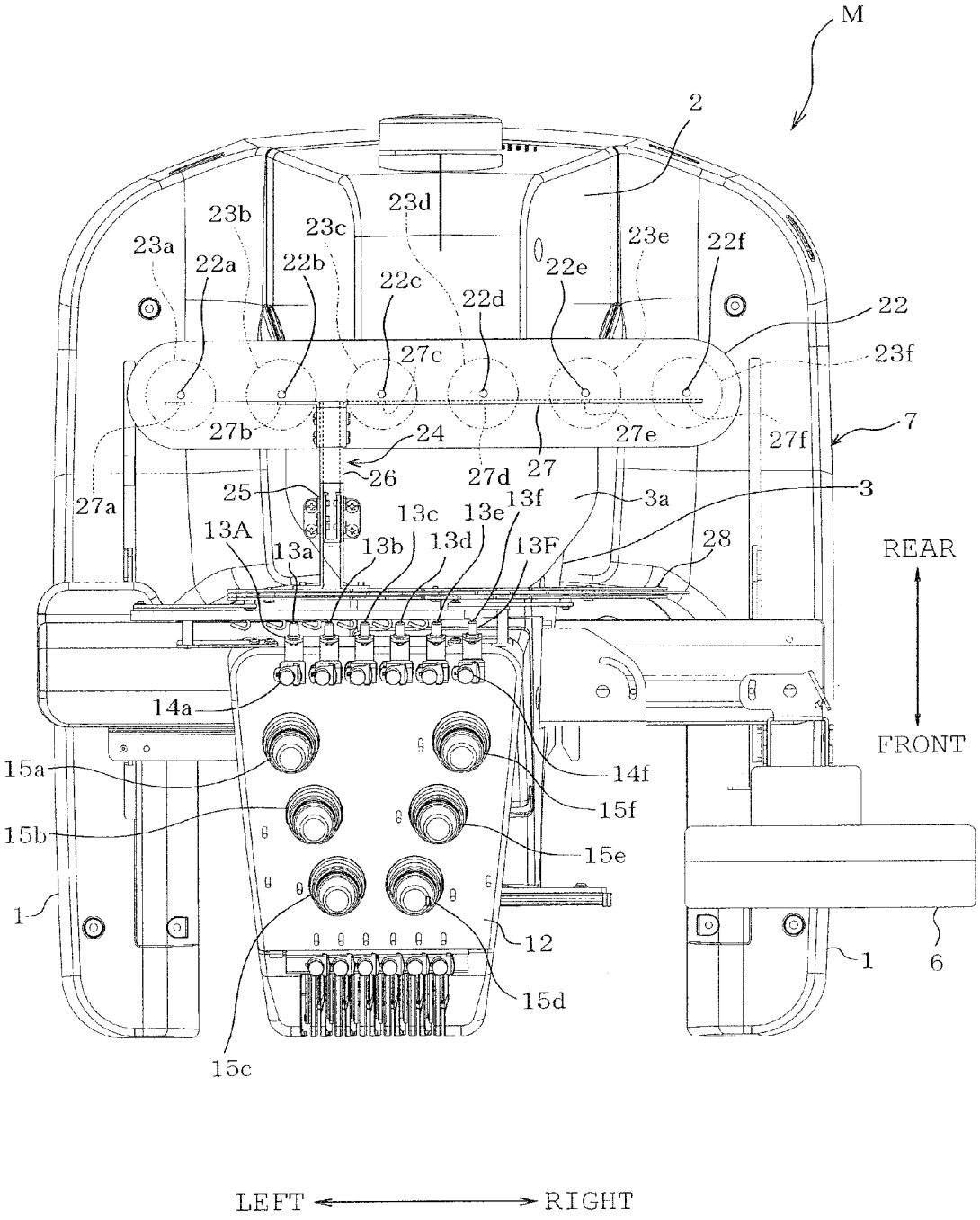
FIG. 5 is a plan view of the multi-needle sewing machine.

A first example will be described with reference to FIGS. 1 to 22. The side of a multi-needle sewing machine M where the user or operator is located is referred to as "front."

Referring to FIGS. 1 to 5, the multi-needle sewing machine M includes a pair of right and left legs 1 supporting the overall sewing machine, a pillar 2 standing on rear ends of the legs 1, an arm 3 extending frontward from an upper part of the pillar 2, a cylinder bed 4 extending frontward from a rear end of the pillar 2, and a needle bar case 5 mounted on a front end of the arm 3. The legs 1, pillar 2, arm 3 and cylinder bed 4 are formed integrally with one another into a sewing machine body 7. A control device (not shown) controlling the overall multi-needle sewing machine M, an operation panel 6 and the like are provided at the sewing machine body 7 side. A needle plate 4*a* is mounted on an upper surface of the cylinder bed 4. The needle plate 4*a* is formed with a needle hole (not shown) serving as a needle position for needles 10*a* to 10*f* as will be described later.

A carriage 8 directed in the right-left direction is disposed above the legs 1. An X-direction drive mechanism (not shown) is provided inside the carriage 8 to drive a frame mounting (not shown) in the X direction (the right-left direction). A 1-direction drive mechanism is provided inside the legs 1 to drive the carriage 8 in the Y direction (the front-back direction). The frame mounting is located in front of the carriage 8. A generally rectangular embroidery frame (not shown) holds a workpiece cloth on which embroidery is to be sewn. The embroidery frame is to be mounted on the frame mounting. The carriage 8 is driven in the Y direction by the Y-direction drive mechanism, and the frame mounting is driven in the X direction by the X-direction drive mechanism as described above. Accordingly, the embroidery frame is moved in the Y direction in synchronization with the carriage 8 and in the X direction with the frame mounting, whereby the workpiece cloth is fed.

Figure 6:
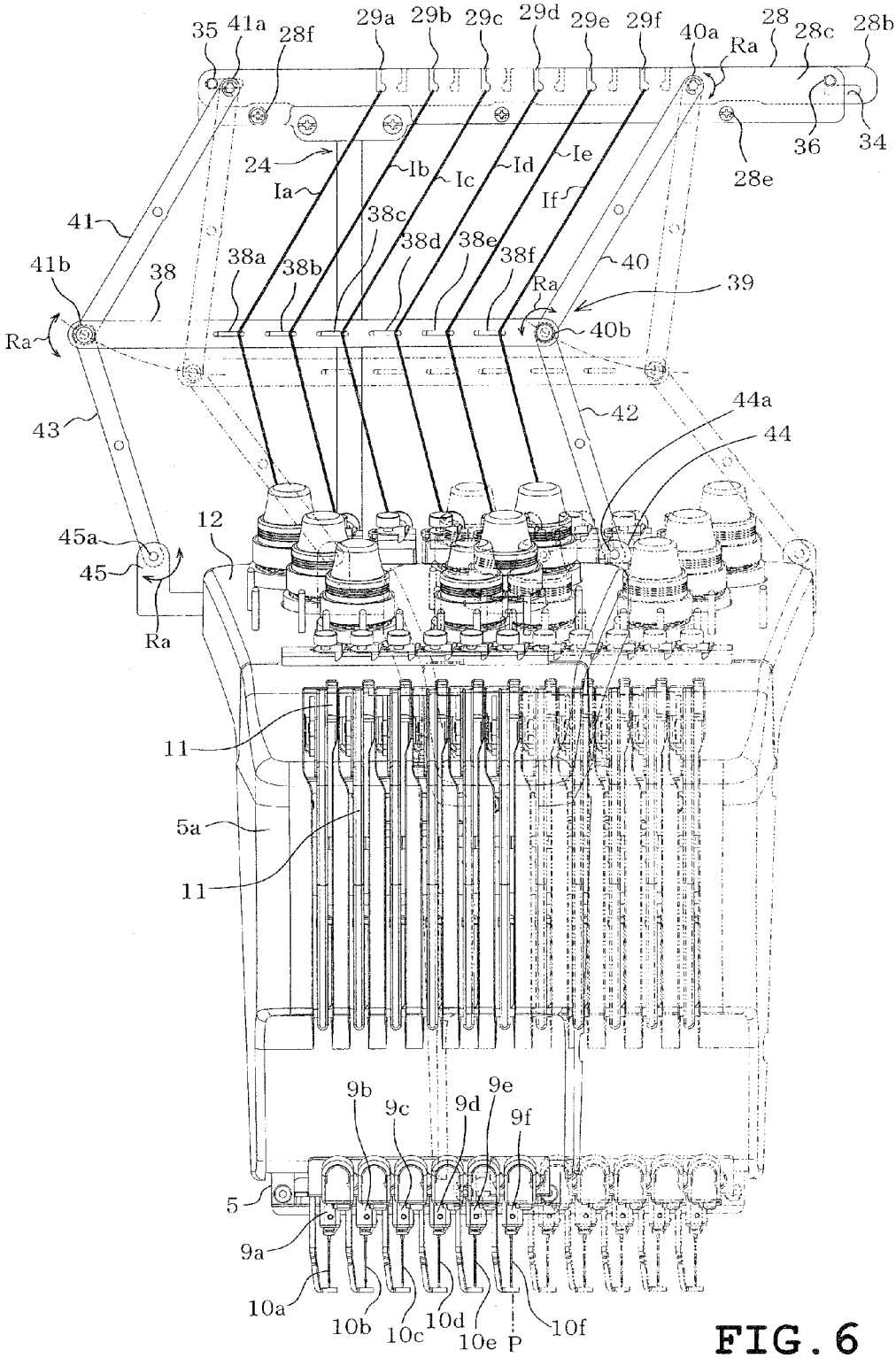
FIG. 6 is a front view of a part of the multi-needle sewing machine from an intermediate thread guide portion moving mechanism to needles.
Figure 7:
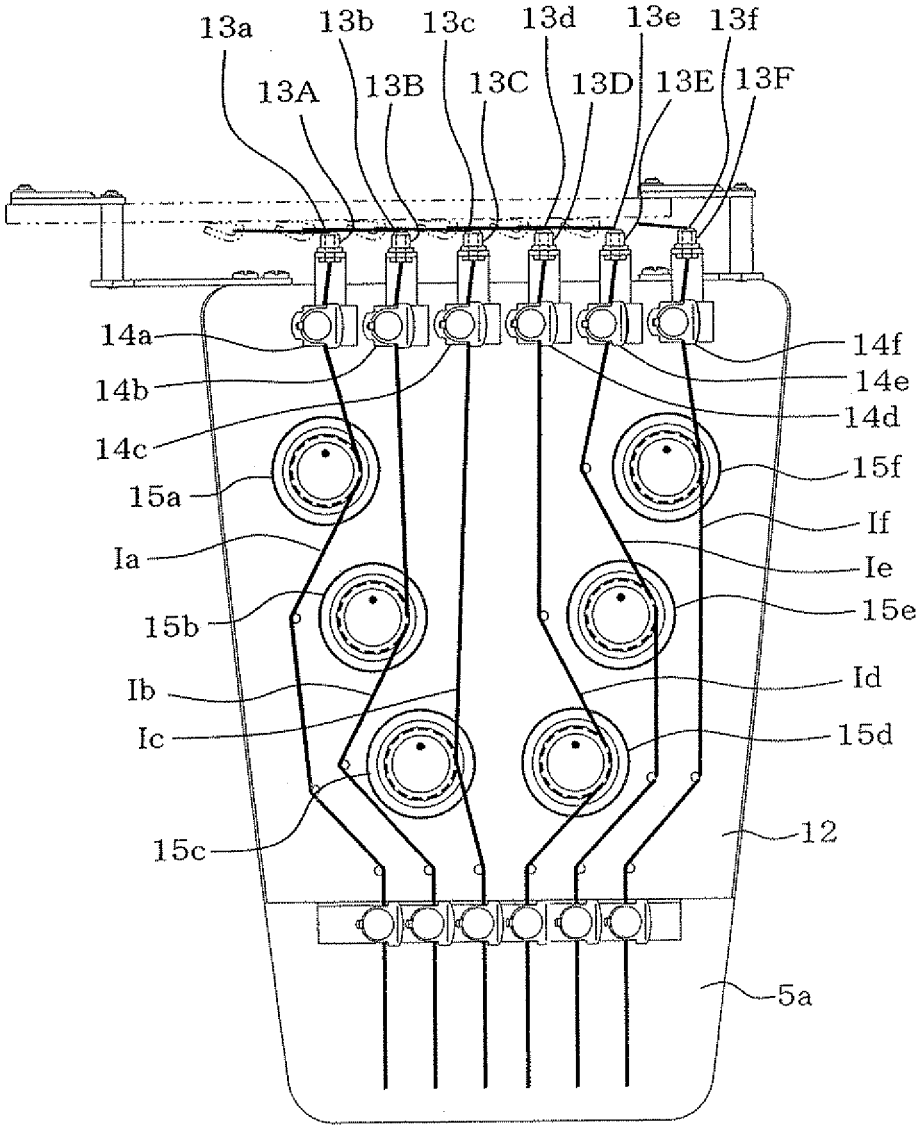
FIG. 7 is a plan view of a thread tension bracket.

Six needle bars 9*a* to 9*f* are arranged in the right-left direction so as to extend in the up-down direction in the needle bar case 5 and supported so as to be movable upward and downward. Six needles 10*a* to 10*f* are attached to lower ends of the needle bars 9*a*-9*f* respectively. Six thread take-up levers 11 corresponding to the respective needle bars 9*a*-9*f* are also provided in the needle bar case 5 so as to be movable upward and downward. A cover 5*a* made of a synthetic resin is mounted on a front side of the needle bar case 5. A thread tension bracket 12 inclined forwardly downward is mounted on the upper surface of the needle bar case 5 so as to be continuous to the upper end of the cover 5*a*. Six cylindrical members 13A to 13F are aligned on a rear end of the thread tension bracket 12 in the right-left direction as shown in FIGS. 6 and 7. The cylindrical members 13A-13F have hollow interiors serving as thread entrances 13*a* to 13*f* respectively. Six auxiliary thread guide portions 14*a* to 14*f* are provided on the front sides of the thread entrances 13*a*-13*f* respectively. Six thread tensioners 15*a* to 15*f* are mounted on the thread tension bracket 12 to adjust tensions of upper threads supplied to the needles 10*a*-10*f* respectively.

Figure 8B:
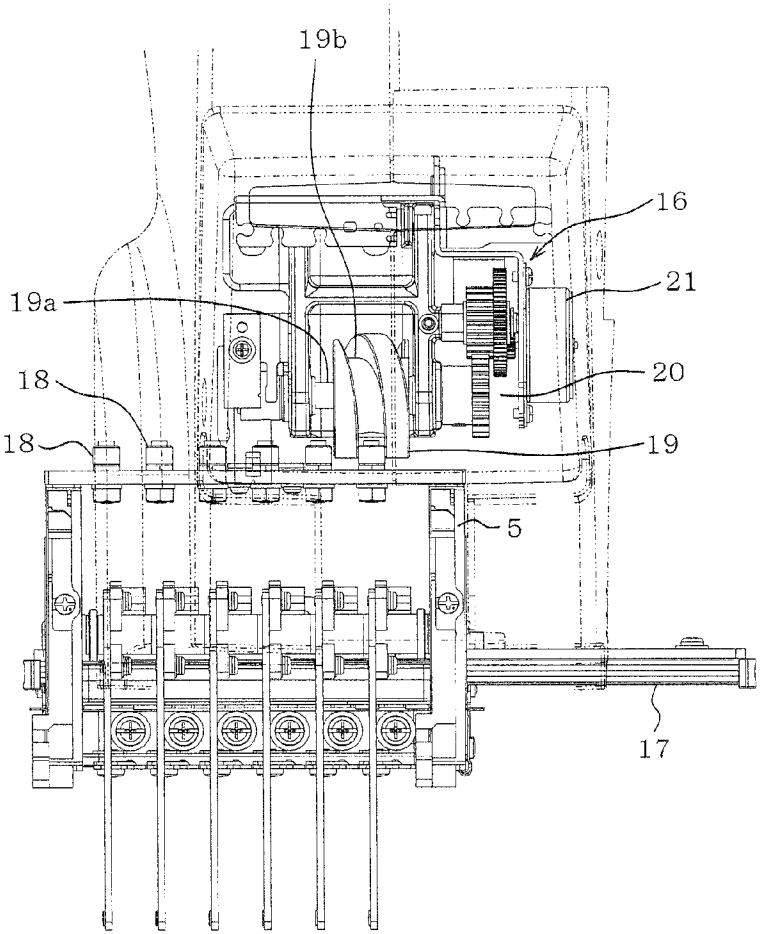
FIGS. 8A and 8B are front views of a needle bar case moving mechanism in two different operating states respectively.
Figure 8A:
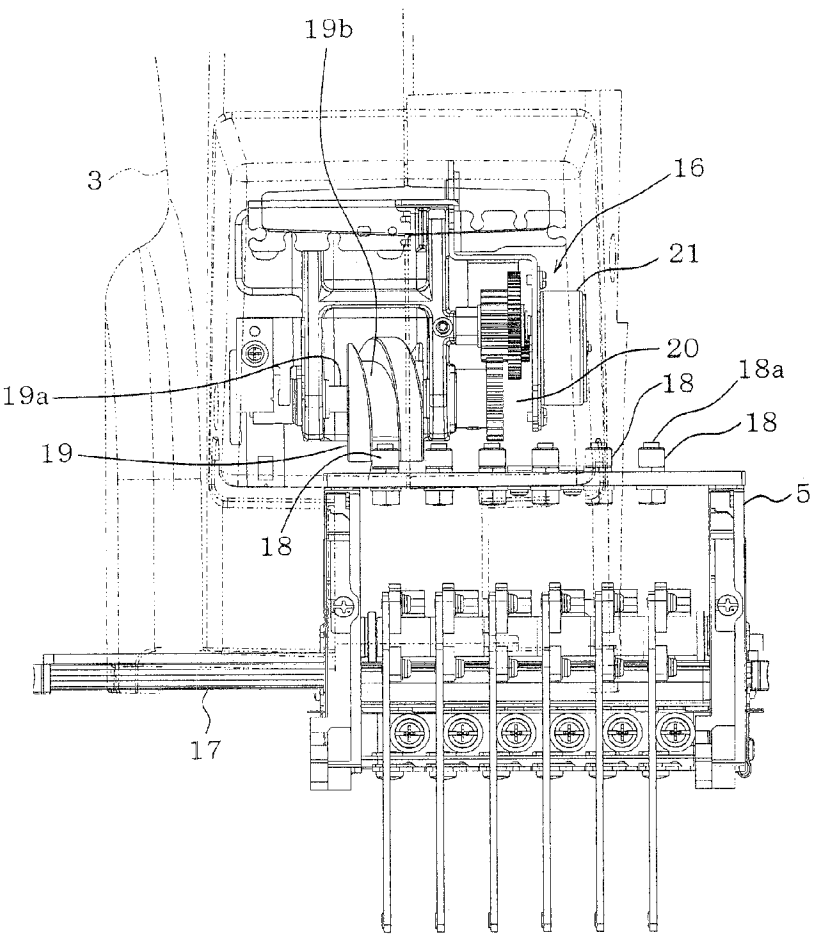

Referring to FIGS. 8A and 8B, a needle bar case moving mechanism 16 moves the needle bar case 5 in the right-left direction so that a predetermined one of the six needle bars 9*a*-9*f* is moved to the needle position that is a sewing position. The needle bar case moving mechanism 16 includes a guide rail 17, six roller bearings 18, a spiral cam 19, a reduction gear assembly 20 and a needle bar case moving motor 21. The guide rail 17 is mounted on the front end of the arm 3 so as to extend in the right-left direction. The needle-case 5 is supported on the guide rail 17 so as to be slid along the guide rail 17.

The needle bar case 5 has an upper rear end protruding toward an upper surface of the front end of the arm 3. The roller bearings 18 are aligned on the upper rear end of the needle bar case 5 in the right-left direction. The roller bearings 18 have the same pitch as the needle bars 9*a*-9*f* and are pivotally mounted on respective shafts 18*a* protruding rearward. The spiral cam 19 is coupled with a shaft 19*a* on the upper surface of the arm 3 so as to be rotatable with it. The shaft 19*a* is directed in the right-left direction. Rotation of the needle bar case moving motor 21 is transmitted via the reduction gear 20 to the shaft 19*a*. The reduction gear 20 is mounted on the upper surface of the arm 3. The spiral cam 19 is formed with a spiral groove 19*b* into which each roller bearing 18 is fittable. Thus, at least one of the roller bearings 18 is fitted in the spiral groove 19*b*.

The spiral cam 19 is rotated in a predetermined direction upon rotation of the needle bar case moving motor 21 in a predetermined direction. The aforesaid roller bearings 18 receive a rightward moving force from the spiral groove 19*b* such that the needle bar case 5 is moved rightward. The needle bar case 5 is moved leftward when the motor 21 is rotated in the direction opposite the aforesaid predetermined direction. Thus, when the needle bar case 5 is moved in the right-left direction relative to the sewing machine body 7 by the needle bar case moving mechanism 16, one of six sets of the needle bars 9*a*-9*f* and the thread take-up lever 11 is selectively changed to the needle position. The selected one set is moved upward and downward in synchronization with drive of a sewing machine motor (not shown) provided in the pillar 2. Furthermore, one set of the needle bar and the thread take-up lever 11 forms embroidery stitches on the workpiece cloth held on the embroidery frame in cooperation with a rotary hook (not shown) mounted on the front end of the cylinder bed 4.

Figure 10:
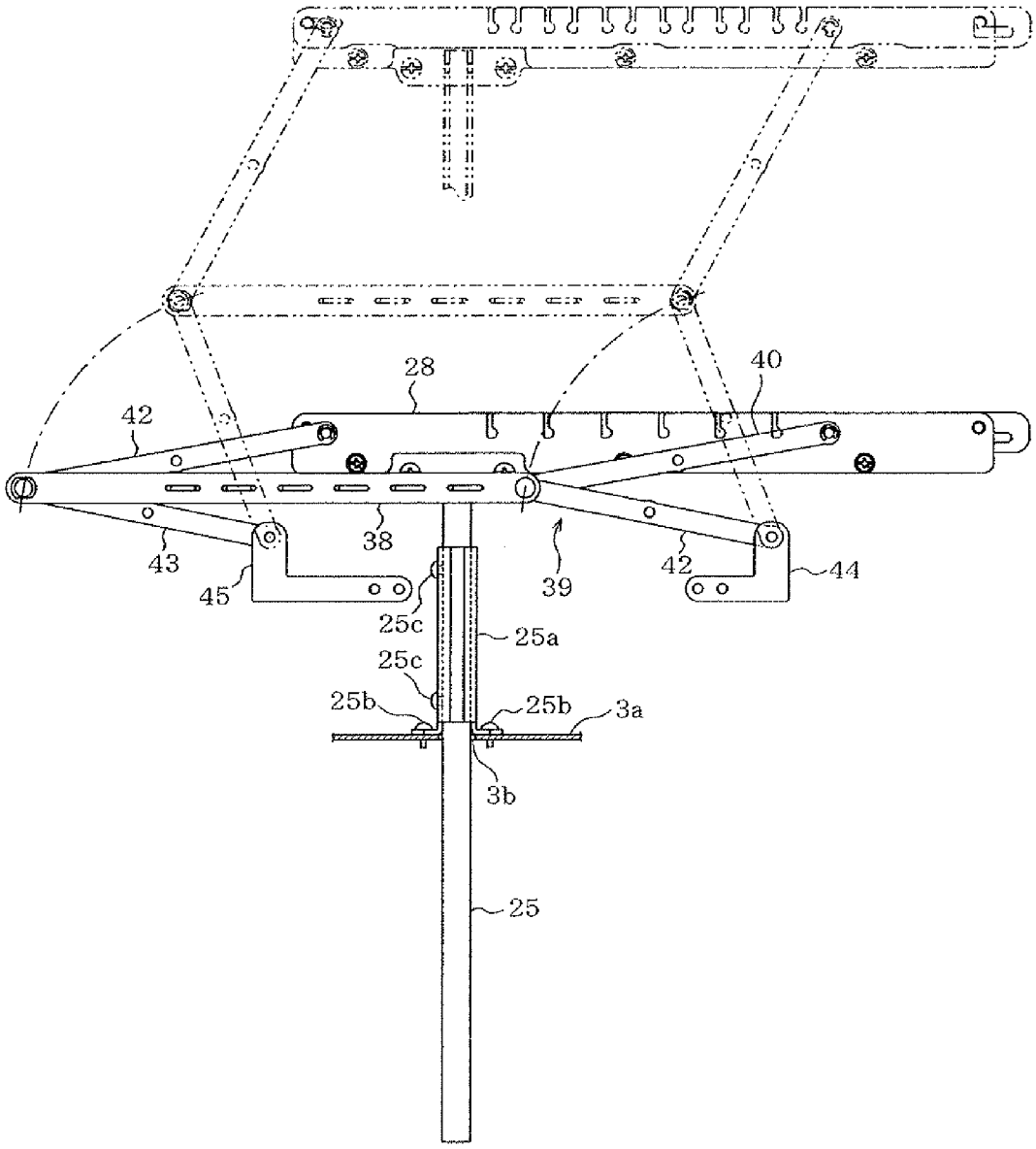
FIG. 10 is a front view of a thread holding members with the pillar being retracted.
Figure 11:
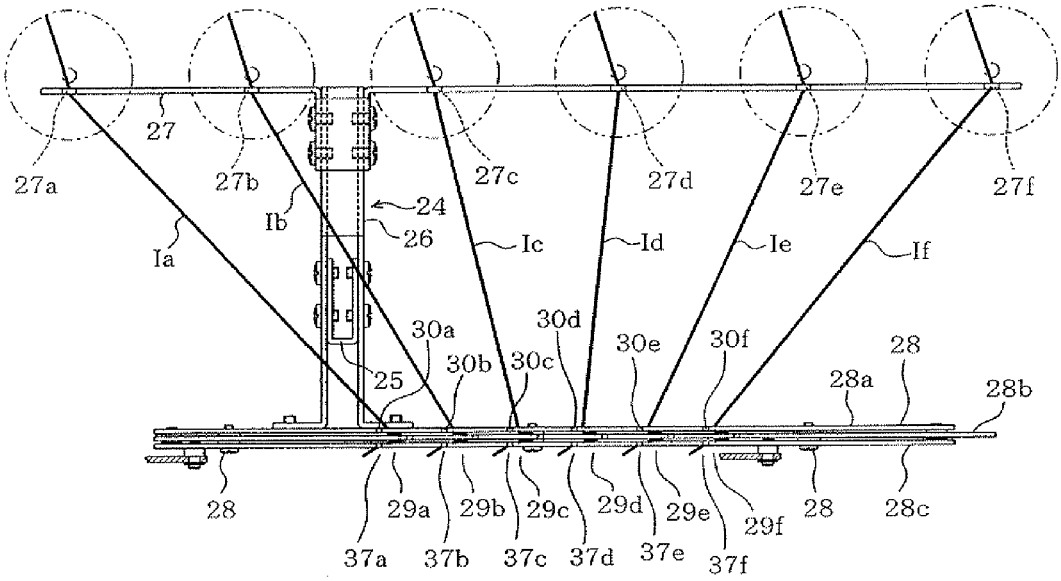
FIG. 11 is a plan view of a part of the multi-needle sewing machine from thread hook members to a machine frame side thread guide member.
Figure 12:
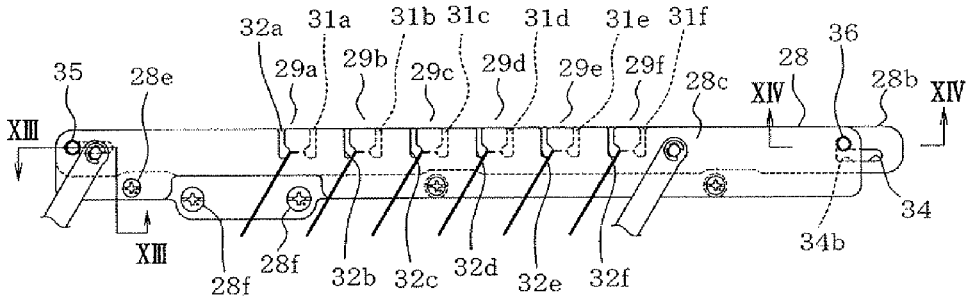
FIG. 12 is a front view of the machine frame side thread guide member.
Figure 13:
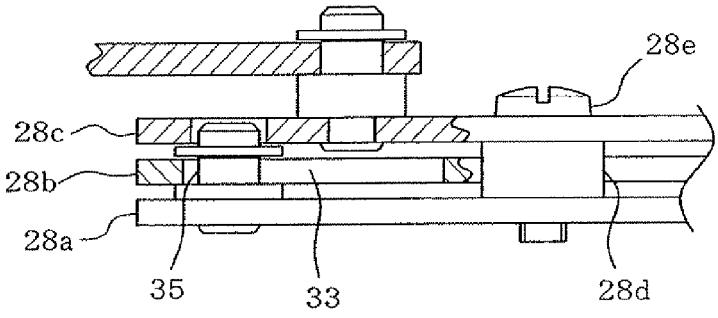
FIG. 13 is a sectional view taken along line XIII-XIII in FIG. 12.
Figure 14:
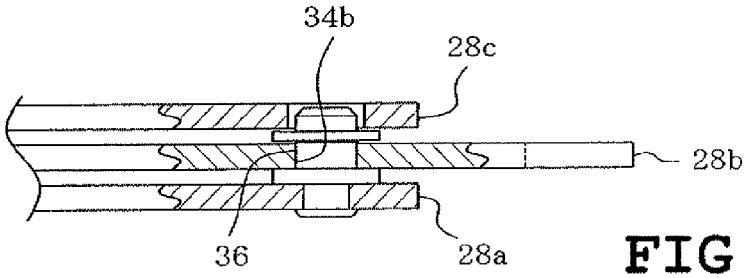
FIG. 14 is a sectional view taken along line XIV-XIV in FIG. 12.

A spool holder base 22 is mounted on a fixed frame 3*a* corresponding to the machine frame mounted on the arm 3 of the sewing machine body 7. Six spool pins 22*a* stand on the spool holder base 22 so as to be aligned in the right-left direction. Six thread spools 23*a* to 23*f* are attached to the spool pins 22*a* respectively. A thread holding member 24 is provided on a front of the fixed frame 3*a* and includes a support holder 25*a*, a support 25, a passing member 26, a thread hooking member 27 and a machine frame side thread guide member 28. The support holder 25*a* is formed into a generally long cylindrical shape in a planar view and fixed to a front right part of the fixed frame 3*a* (a part protruding from the arm 3) by screws 25*b* so as to stand on the fixed frame 3*a*. A support insertion hole 3*b* is formed in the front right part of the fixed frame 3*a* and is slightly larger than a hollow interior of the support holder 25*a* in a planar view as shown in FIG. 10.

The support 25 has a lower end that is inserted into the support holder 25*a* and fixed by a screw 25*c*. The passing member 26 is fixed to an upper end of the support 25 by a screw 26*a* so as to be directed in the front-back direction. The thread hooking member 27 is fixed to a rear end of the passing member 26 by a screw 27*g* so as to be directed in the right-left direction. The thread hooking member 27 has six threading holes (see FIG. 4) which are formed therein so as to be located substantially right above the respective spool pins 22*a*. The machine frame side thread guide member 28 is fixed to a front end of the passing member 26 so as to be directed in the right-left direction.

The machine frame side thread guide member 28 has three elongate plate members 28*a*, 28*b* and 28*c* stacked one upon another as shown in FIGS. 11 to 18. The plate members 28*a* and 28*b* are spaced from each other so that a thread is allowed to pass therebetween in a curved state, as will be described in detail later. The plate members 28*b* and 28*c* are also spaced from each other so that a thread is allowed to pass therebetween in a curved state. Both outer plate members 28*a* and 28*c* are fixed by a spacer 28*d* (see FIG. 13) and a screw 28*e* so that a space allowing movement of the intermediate plate member 28*b* is defined therebetween. The machine frame side thread guide member 28 is provided with six machine frame side thread guide portions 29*a* to 29*f* including six outer thread insertion holes 30*a* to 30*f* formed in one outer plate member 28*a*, six outer thread insertion holes 32*a* to 32*f* formed in the other outer plate member 28*c*, and six inner thread insertion holes 31*a* to 31*f* formed in the intermediate plate member 28*b*.

The outer thread insertion holes 30*a*-30*f* are formed substantially at regular intervals in the outer plate member 28*a*. The outer thread insertion holes 32*a*-32*f* are also formed substantially at regular intervals in the other outer plate member 28*c* so as to correspond to the outer thread insertion holes 30*a*-30*f* respectively in a front view. The outer thread insertions holes 30*a*-30*f* and 32*a*-32*f* have upper portions open at upper ends of the plate members 28*a* and 28*c* respectively. The inner thread insertion holes 31*a*-31*f* are formed in the intermediate plate member 28*b* and have the same intervals as the outer thread insertion holes 30*a*-30*f* and 32*a*-32*f*. The inner thread insertion holes 31*a*-31*f* also have upper portions open at upper ends of the intermediate plate member 28*b* respectively.

The intermediate plate member 28*b* has a left end formed with a guide groove 33 (see FIG. 17) which is directed in the right-left direction and comprises an elongate hole. The plate member 28*b* has a right end formed with a guide groove 34 comprising an upwardly directed hole 34*a* and a horizontally directed elongate hole 34*b* both of which are continuous to each other. Two guide pins 35 and 36 mounted on the outer plate members 28*a* and 28*c* are inserted through the guide grooves 33 and 34 respectively. As a result, the intermediate plate member 28*b* is switchable between a use position (a position during sewing) as shown in FIG. 17 and a threading position as shown in FIG. 18.

Figure 17:
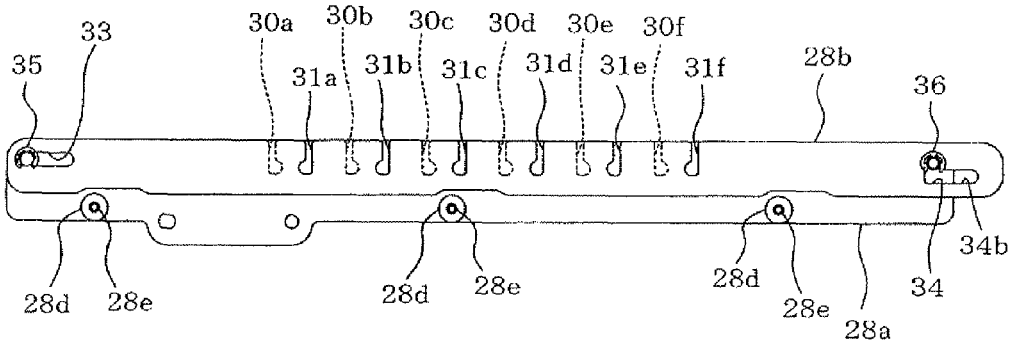
FIG. 17 is a front view of the machine frame side thread guide member with a front side plate member being eliminated.
Figure 18:
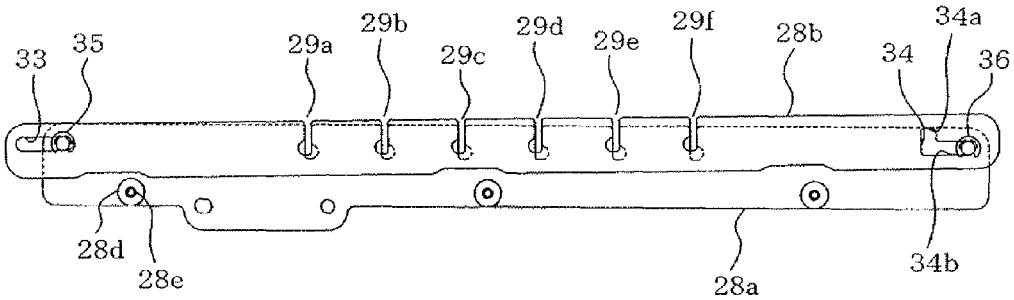
FIG. 18 is a view similar to FIG. 17 with an intermediate plate member located at a different position.
Figure 19:
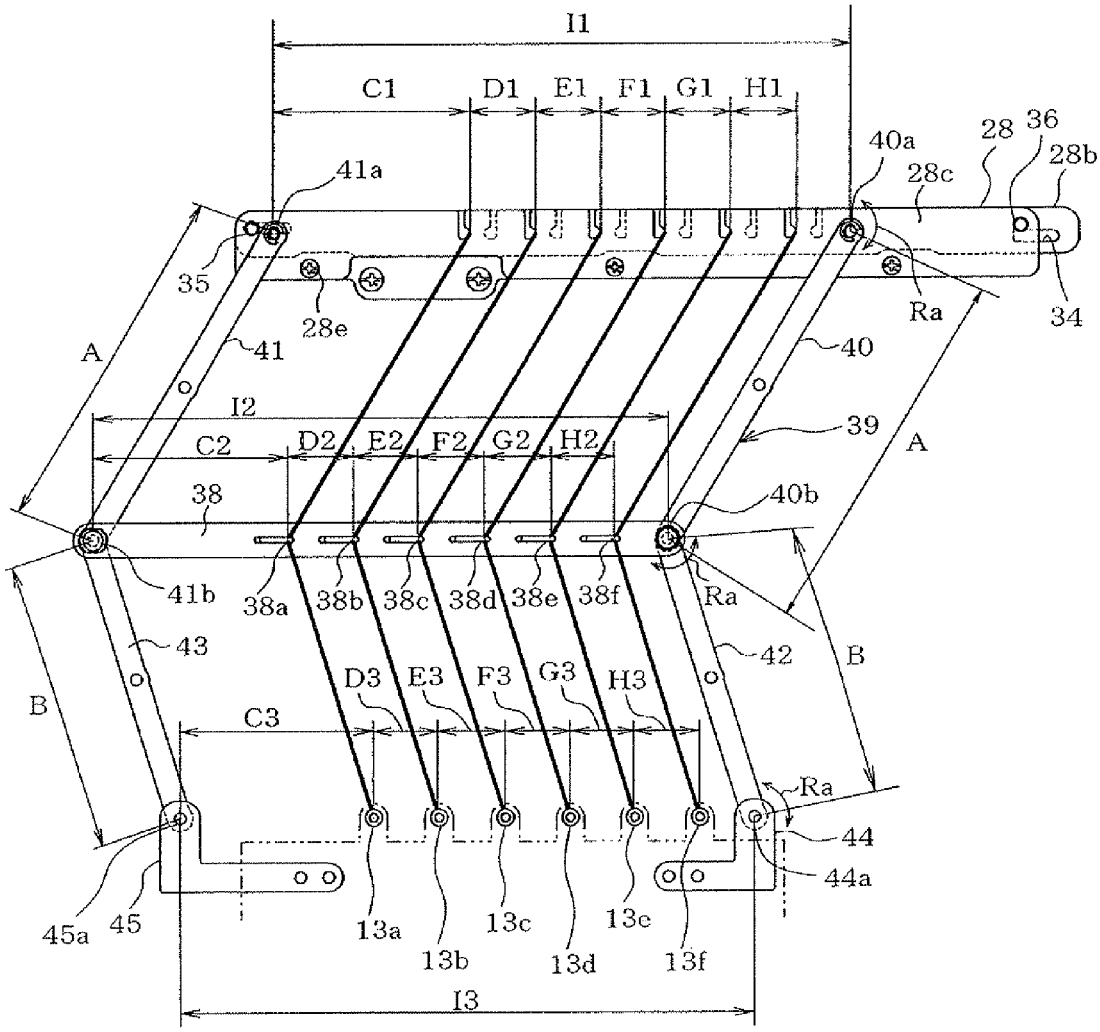
FIG. 19 is a front view of an intermediate thread guide portion moving mechanism.
Figure 20:
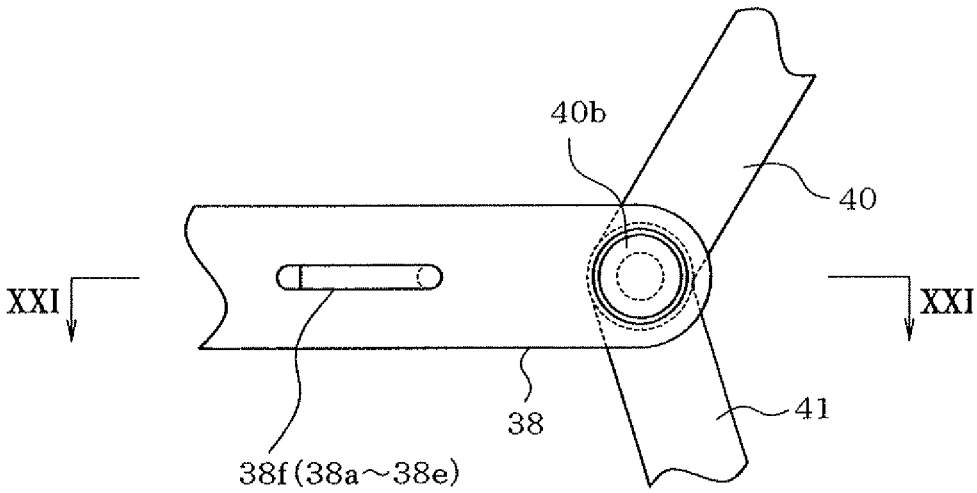
FIG. 20 is a front view of one end of the intermediate thread guide member.

When the intermediate plate member 28*b* is located at the use position as shown in FIG. 17, the guide pin 36 is fitted in the upward hole 34*a* of the guide groove 34 thereby to prevent the intermediate plate member 28*b* from rightward and leftward movement. In this state, the inner thread insertion holes 31*a*-31*f* are shifted in the right direction relative to the outer thread insertion holes 30*a*-30*f* and 32*a*-32*f*. Furthermore, when the intermediate plate member 28*b* is located at the threading position as shown in FIG. 18, the locations of the inner thread insertion holes 31*a*-31*f* correspond substantially to the locations of the outer thread insertion holes 30*a*-30*f* and 32*a*-32*f* respectively.

Figure 9:
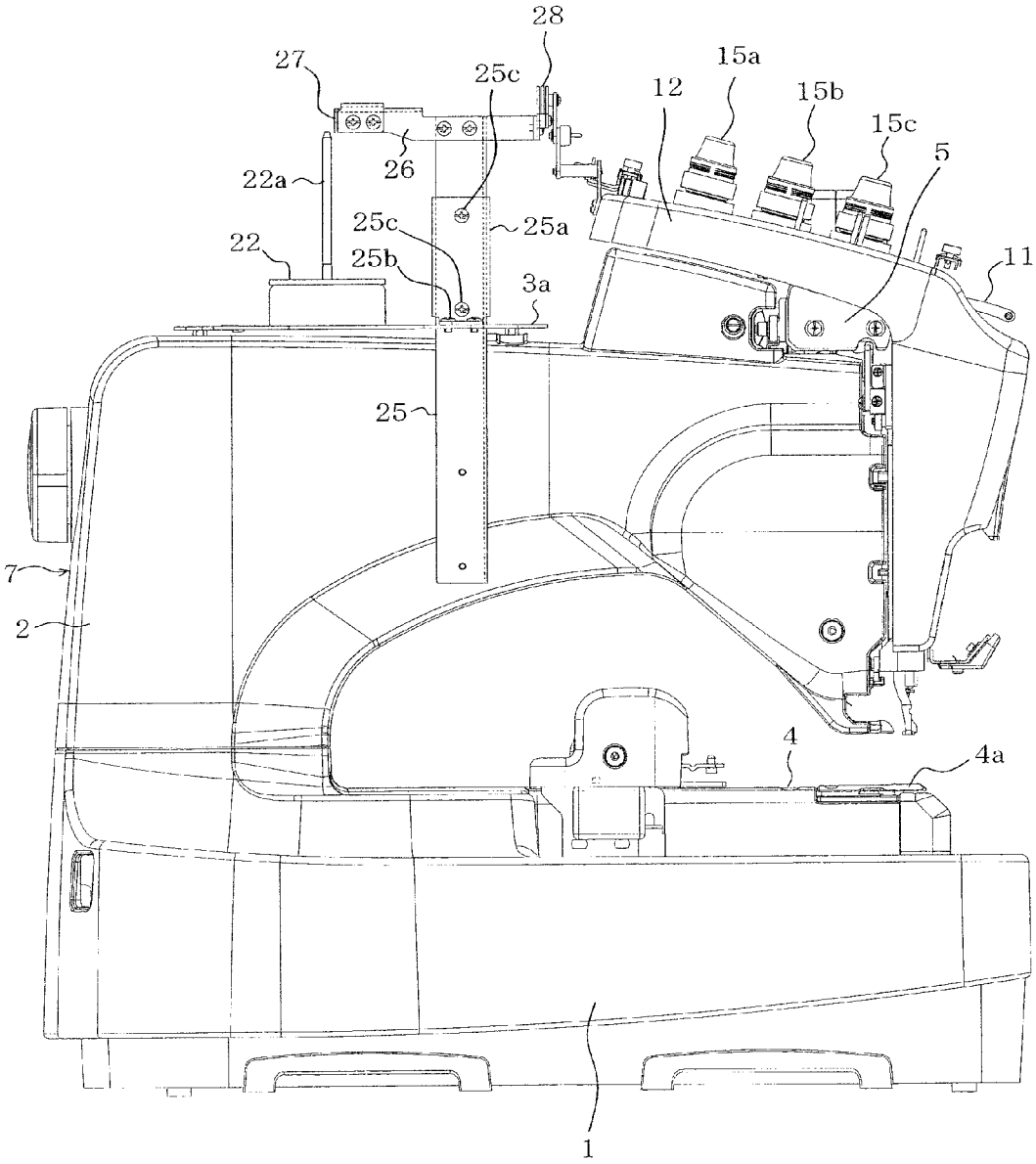
FIG. 9 is a left side view of the multi-needle sewing machine with a pillar being retracted.
Figure 15:
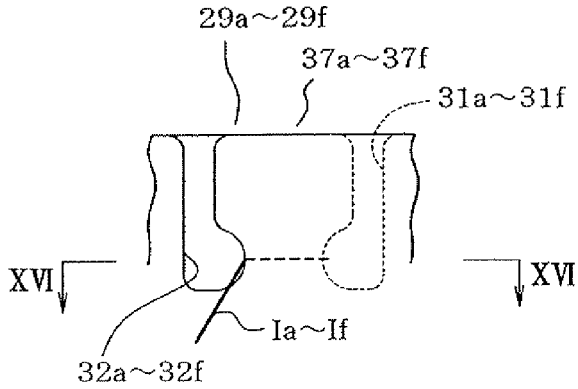
FIG. 15 is a front view of the machine frame side thread guide member.
Figure 16:
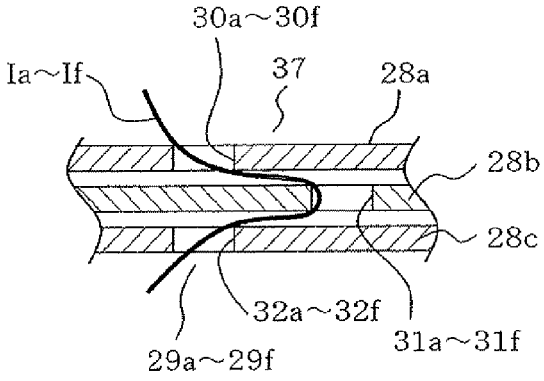
FIG. 16 is a sectional view taken along line XVI-XVI in FIG. 15.

The outer thread insertion holes 30*a*-30*f* and 32*a*-32*f* and the inner thread insertion holes 31*a*-31*f* constitute the machine frame side thread guides 29*a*-39*f* respectively and further constitute curving units 37*a*-37*f* respectively. When the intermediate plate member 28*b* is located at the threading position as shown in FIG. 18, the thread can be inserted, from above, through the outer thread insertion holes 30*a*-30*f* and 32*a*-32*f* and the inner thread insertion holes 31*a*-31*f* positionally correspond to one another respectively. When the intermediate plate member 28*b* is moved to the use position as shown in FIG. 17 in this state, the threads are curved by the curving units 37*a*-37*f* which are constructed so that the inner thread insertion holes 31*a*-31*f* are shifted in the right direction relative to the outer thread insertion holes 30*a*-30*f* and 32*a*-32*f* respectively as shown in FIGS. 15 and 16. The support 25 is movable downward (a retracted position as shown in FIGS. 9 and 10) in the support holder 25*a* and the support insertion hole 3*b* relative to the support holder 25*a* by loosening the screw 25*c*. In this case, an intermediate thread guide member 38 and an intermediate thread guide moving mechanism 39 both of which will be described later are also retracted as well as the support 25.

Figure 21:
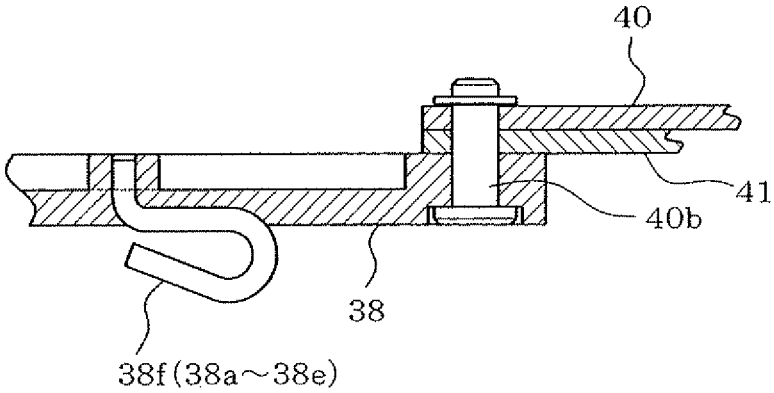
FIG. 21 is a sectional view taken along line XXI-XXI in FIG. 20.

Six intermediate thread guide portions 38*a* to 38*f* are located between the machine frame side thread guide portions 29*a* to 29*f* and the thread entrances 13*a*-13*f* respectively as shown in FIGS. 1 and 6. The intermediate thread guide portions 38*a*-38*f* are provided on the intermediate thread guide member 38 at the same intervals as the machine frame side thread guide portions 29*a*-29*f*. The intermediate thread guide portions 38*a*-38*f* are made by bending metal wire rods generally into a U-shape in a plan view, as shown in FIG. 21.

The intermediate thread guide portion moving mechanism 39 moves the intermediate thread guide portions 38*a*-38*f* according to movement of the needle bar case 5 when the thread entrances 13*a*-13*f* are moved with the movement of the needle bar case 5, as shown in FIGS. 1 to 6 and 19. The intermediate thread guide portion moving mechanism 39 includes a pair of first link members 40 and 41 and a pair of second link members 42 and 43. The first link members 40 and 41 are set so as to have the same length (the same link length A), and the second link members 42 and 43 are set so as to have the same length (the same link length B). The first link member 40 has one (an upper end as viewed in FIGS. 6 and 19) of two ends that is formed with a pivot pin 40*a* which is mounted on one (a right end as viewed in FIG. 6) of two ends of the machine frame side thread guide member 28 so that the first link member 40 is pivotally movable about the pivot pin 40*a* in a direction of arrow Ra (see FIG. 19). The first link member 40 has the other end that is formed with a pivot pin 40*b* which is mounted on one (a right end as viewed in FIG. 6) of two ends of the intermediate thread guide member 38 so that the first link member 40 is pivotally movable about the pivot pin 40*b* in the direction of arrow Ra.

The other first link member 41 has one (an upper end as viewed in FIGS. 6 and 19) of two ends that is formed with a pivot pin 41*a* which is mounted on the other end (a left end) of the machine frame side thread guide member 28 so that the first link member 41 is pivotally movable about the pivot pin 41*a* in the direction f arrow Ra. The first link member 41 has the other end that is formed with a pivot pin 41*b* which is mounted on the other end of the intermediate thread guide member 38 so that the first link member 41 is pivotally movable about the pivot pin 41*b* in the direction of arrow Ra.

A support piece 44 has a support shaft 44*a*, and the second link member 42 has one (a lower end as viewed in FIGS. 6 and 19) of two ends that is mounted on a support shaft 44*a* so that the second link member 42 is pivotable in the direction of arrow Ra. The support piece 44 is provided near the thread entrance which constitutes one end of the row of thread entrances 13*a*-13*f* of the needle bar case 5. Furthermore, the second link member 42 has the other end (an upper end as viewed in FIGS. 6 and 19) that is mounted on the pin 40*b* mounted on the aforesaid one end of the intermediate thread guide member 38 so that the second link member 42 is pivotable in the direction of arrow Ra.

A support piece 45 has a support shaft 45*a*, and the other second link member 43 has one (a lower end as viewed in FIGS. 6 and 19) of two ends that is mounted on the support shaft 45*a* so that the support piece 45 is pivotable in the direction of arrow Ra. The support piece 45 is provided near the thread entrance which constitutes the other end of the row of thread entrances 13*a*-13*f* of the needle bar case 5. Furthermore, the second link member 43 has the other end that is mounted on the pin 41*b* mounted on the aforesaid other end of the intermediate thread guide member 38 so that the second link member 43 is pivotable in the direction of arrow Ra.

Reference symbols I1, I2 and I3 designate a distance between the pins 40*a* and 41*a*, a distance between the pins 40*b* and 41*b* and a distance between the support shafts 44*a* and 45*a* respectively. These distances I1, I2 and I3 are set so as to be equal to one another. Furthermore, the first link members 40 and 41 have the same length A, and the second link members 42 and 43 have the same length B. A parallel link mechanism is constituted by the paired first link members 40 and 41, the paired second link members 42 and 43 and the intermediate thread guide member 38.

Reference symbols C1, C2 and C3 designate a distance between the pin 41*a* and the machine frame side thread guide portion 29*a*, a distance between the pin 41*b* and the intermediate thread guide portion 38*a* and a distance between the support shaft 45*a* and the thread entrance 13*a* respectively. These distances C1, C2 and C3 are set so as to be equal to one another. Furthermore, reference symbols D1, E1, F1, G1 and H1 designate distances between the machine frame side thread guide portions 29*a*-29*f* respectively. Reference symbols D2, E2, F2, G2 and H2 designate distances between the thread entrances 13*a*-13*f* corresponding to the distances D1, E1, F1, G1 and H1, respectively. Reference symbols D3, E3, F3, G3 and H3 designate distances between the thread entrances 13*a*-13*f* respectively. These distances D1, E1, F1, G1 and H1, D2, E2, F2, G2 and H2 and D3, E3, F3, G3 and H3 are set so as to be equal to one another, respectively, that is, D1=D2=D3, E1=E2=E3 and so on.

Threads (upper threads) Ia to If of the thread spools 23*a*-23*f* are passed through the threading holes 27*a*-27*f*, the machine frame side thread guide portions 29*a*-29*f* and the intermediate thread guide portions 38*a*-38*f* to be introduced into the thread entrances 13*a*-13*f* respectively. The threads having been introduced into the thread entrances 13*a*-13*f* are further passed through auxiliary thread guide portions 14*a* to 14*f*, thread tensioners 15*a* to 15*f*, thread take-up levers 11 and the like thereafter to be passed through eyes (not shown) of the needles 10*a* to 10*f*, respectively. Accordingly, the intermediate thread guide portions 38*a*-38*f* of the intermediate thread guide member 38 guide the intermediate portions of the threads Ia-If between the machine-frame side thread guide portions 29*a*-29*f* serving as a fixed side and the thread entrances 13*a*-13*f* serving as a movement side.

Figure 22:
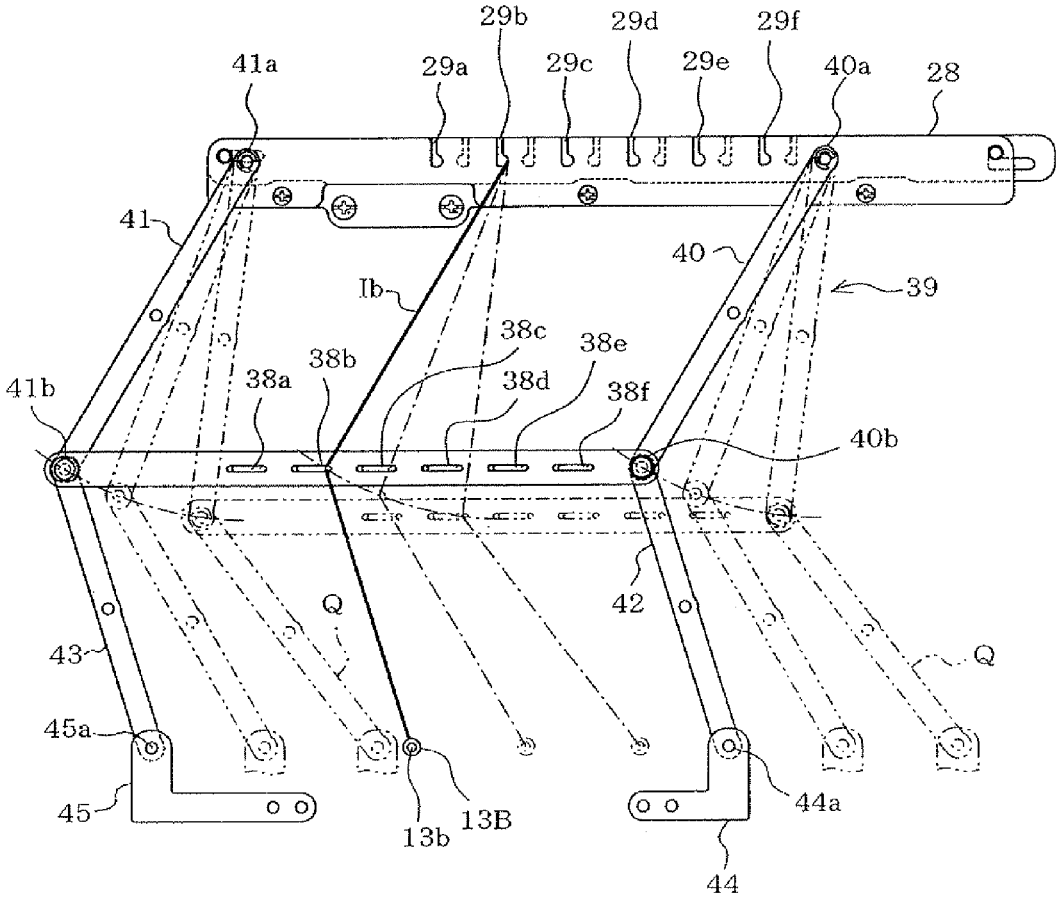
FIG. 22 is a front view of the intermediate thread guide portion moving mechanism, explaining the operation thereof.

The above-described multi-needle sewing machine will work as follows. The needle bar case 5 is moved by the needle-bar moving mechanism 16 so that one of the needle bars 9*a*-9*f* is located at the sewing position P (see FIG. 6). In this case, a leftmost movement position is the position (a position shown by solid line in FIGS. 6 and 22) where the needle bar 9*f* corresponds to the sewing position P. A rightmost movement position is the position (a position shown by two-dot chain line in FIG. 6) where the needle bar 9*a* corresponds to the sewing position P. The thread entrances 13*a*-13*f* are also moved in the right-left direction with the movement of the needle bar case 5 in the right-left direction. FIG. 22 shows only one thread Ib for the sake of easiness in the explanation of operation of the intermediate thread guide portion moving mechanism 39. However, it is assumed that six threads Ia-If would actually be used.

The lower ends of the first link members 40 and 41 of the second link members 42 and 43 of the intermediate thread guide portion moving mechanism 39 are also moved with the movement of the needle bar case 5. As a result, the first and second link members 40, 41 and 42, 43 are curved in the right-left direction. With this, the intermediate thread guide member 38 is also moved in the right-left direction. In this case, the second link members 42 and 43 are swung in parallel to each other, and the first link members 40 and 41 are also swung in parallel to each other. The intermediate thread guide member 38 is moved in parallel to the rows of the machine frame side thread guide portions 29*a*-29*f* and the thread entrances 13*a*-13*f*. As a result, the intermediate thread guide portions 38*a*-38*f* are also moved in parallel to one another while being spaced from one another.

The threads Ia-If between the machine frame side thread guide portions 29*a*-29*f* which are at the fixed side and the intermediate thread guide portions 38*a*-38*f* of the intermediate thread guide member 38 during the foregoing movement of the needle bar case 5, respectively. In the example, however, the intermediate portions of the threads Ia-If between the machine frame side thread guide portions 29*a*-29*f* and the thread entrances 13*a*-13*f* are guided by the intermediate thread guide portions 38*a*-38*f* individually, respectively. Consequently, the threads Ia-If can effectively be prevented from being entangled. In this case, if the intermediate thread guide member 38 should be fixed (immovable) in the same manner as the machine frame side thread guide portions 29*a*-29*f*, it would be difficult to prevent each one of the threads Ia-If between the guide portions 29*a*-29*f* and 38*a*-38*f* from being entangled with the adjacent threads. In the foregoing example, however, the intermediate thread guide portion moving mechanism 39 moves the intermediate thread guide portions 38*a*-38*f* according to the movement of the needle bar case 5 during the movement of the thread entrances 13*a*-13*f* with the movement of the needle bar case 5 while the guide portions 38*a*-38*f* are spaced from one another. Thus, the intermediate thread guide portions 38*a*-38*f* are moved between the guide portions 29*a*-29*f* and the thread entrances 13*a*-13*f* while being spaced from one another. Consequently, the threads Ia-If can be prevented from being entangled with one another, and an occurrence of thread entanglement can reliably be prevented. Moreover, the thread spools 23*a*-23*f* are provided on the sewing machine frame (the fixed frame 3*a*) but not on the needle bar case 5, which construction differs from the construction of conventional multi-needle sewing machines in which the needle bar case 5 and the spool holder base to which the thread spools 23*a*-23*f* are attached are moved together. Accordingly, the foregoing construction of the example is simplified and rendered more compact as compared with the conventional construction. Additionally, the multi-needle sewing machine M is constructed so that the intermediate portions of the threads Ia-If are guided through the intermediate thread guide portions 38*a*-38*f*. This does not necessitate the troublesome work of passing the threads through the elongate tubes respectively, and the threading work can also be simplified.

Furthermore, the intermediate thread guide portion moving mechanism 39 is constructed into the parallel link mechanism including the paired first link members 40 and 41, the paired second link members 42 and 43 and the intermediate thread guide portions 38*a*-38*f*. Accordingly, the plural intermediate thread guide portions 38*a*-38*f* are moved substantially in parallel to the movement direction of the thread entrances 13*a*-13*f*. Consequently, an occurrence of thread entanglement can reliably be prevented. Furthermore, when the intermediate thread guide member 38 has been moved by the intermediate thread guide portion moving mechanism 39, the lengths of the threads Ia-If from the machine frame side thread guide portions 29*a*-29*f* to the thread entrances 13*a*-13*f* are substantially limited to the length (A+B) of addition of the lengths of the first and second link members (41) and 42 (43). As a result, the threads Ia-If can be prevented from being loosened.

Furthermore, the machine frame side thread guide portions 29*a*-29*f* of the machine frame side thread guide member 28 includes the curving units 37*a*-37*f* which curve the threads Ia-If respectively. As a result, a slight passage resistance is applied to each of the threads Ia-If, whereby the behavior of each thread can be rendered more stable. Furthermore, the machine frame side thread guide member 28 includes three elongate plate members 28*a*, 28*b* and 28*c* which are stacked one upon another. The outer plate members 28*a* and 28*c* have the outer thread insertion holes 30*a*-30*f* and 32*a*-32*f* whose positions correspond with one another, respectively. The intermediate plate member 28*b* is formed with the inner thread insertion holes 31*a*-31*f* shifted from the outer thread insertion holes 30*a*-30*f* and 32*a*-32*f* respectively. These thread insertion holes 30*a*-30*f*, 31*a*-31*f* and 32*a*-32*f* constitute the curving units 37*a*-37*f* respectively. Consequently, the threads Ia-If can be curved easily and reliably.

Second Example

Figure 23:
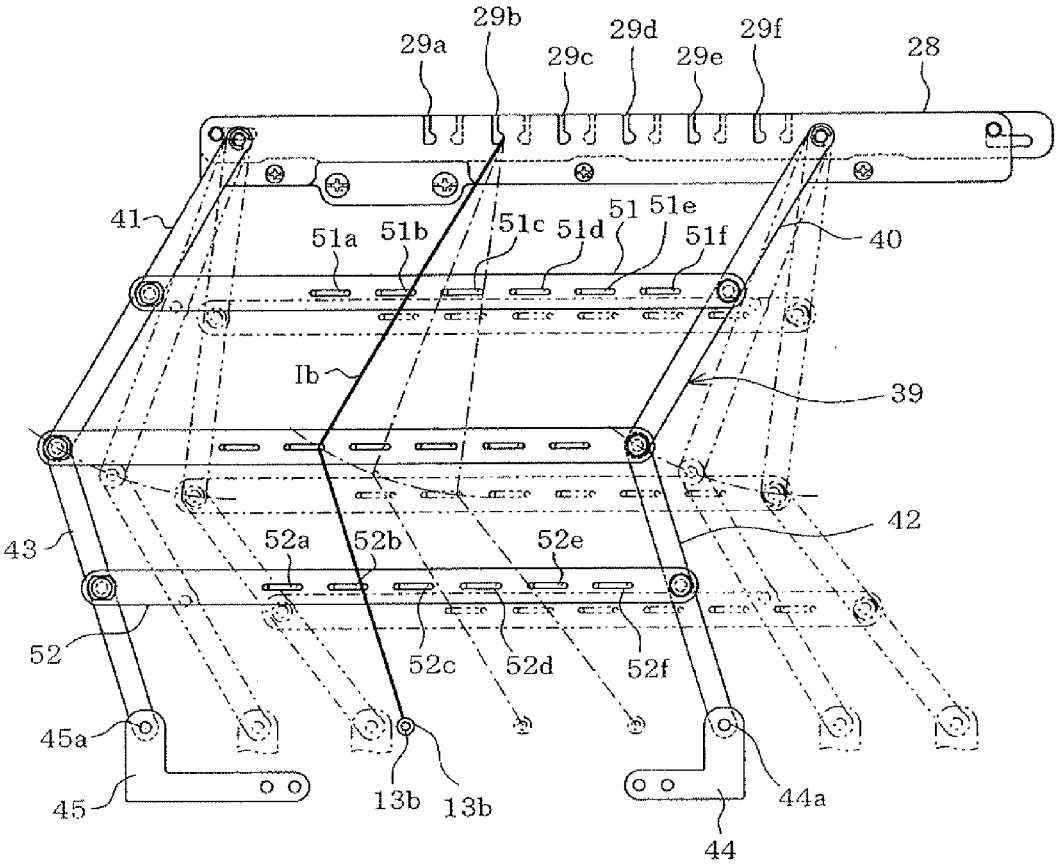
FIG. 23 is a view similar to FIG. 22, showing the multi-needle sewing machine of a second example.

FIG. 23 illustrates a second example. Two intermediate thread guide members 51 and 52 are added to the intermediate thread guide portion moving mechanism 39 in the second example. The upper intermediate thread guide member 51 is pivotally mounted between the intermediate portions of the first link members 40 and 41. The lower intermediate thread guide member 52 is pivotally mounted between the intermediate portions of the second link members 42 and 43. The intermediate thread guide members 51 and 52 are provided with the intermediate thread guide portions 51*a*-51*f* and 52*a*-52*f* guiding the threads Ia-If respectively in the same manner as the intermediate thread guide member 38. Although only one thread Ib is shown in FIG. 23 for the sake of easiness in the explanation of the operation of the intermediate thread guide portion moving mechanism, it is assumed that six threads Ia-If would be provided as shown in FIGS. 1 and 6.

According to the above-described second example, the thread Ia-If can further be prevented from being loosened.

Third Example

FIGS. 24 to 28 illustrate a third example. The third example differs from the first example in the construction of the intermediate thread guide portion moving mechanisms 61*a* to 61*f*. The intermediate thread guide portion moving mechanisms 61*a* to 61*f* are provided so as to correspond to the intermediate thread guide portions 62*a* to 62*f* (shown in FIG. 27) respectively. The intermediate thread guide portion moving mechanisms 61*a* to 61*f* have respective first arm members 63*a* to 63*f* and respective second arm members 64*a* to 64*f*. Pins 67*a* to 67*f* (see FIG. 26) are mounted on the machine frame side thread guide members 50 as to be located near the machine frame side 66*a* to 66*f* (substantially beneath the guide portions 66*a*-66*f* as viewed in FIG. 24) respectively. The first arm members 63*a*-63*f* have one ends which are pivotally mounted on the pins 67*a* to 67*f* respectively. Pins 68*a* to 68*f* (shown in FIG. 27) are mounted on one ends of the second arm members 64*a*-64*f* respectively. The first arm members 63*a*-63*f* have the other ends which are pivotally mounted on the pins 68*a*-68*f* respectively. The second arm members 64*a*-64*f* have the other ends which are pivotally mounted on the cylindrical members 13A to 13F defining the thread entrances 13*a*-13*f* so as to be located near the thread entrances, respectively.

Figure 24:
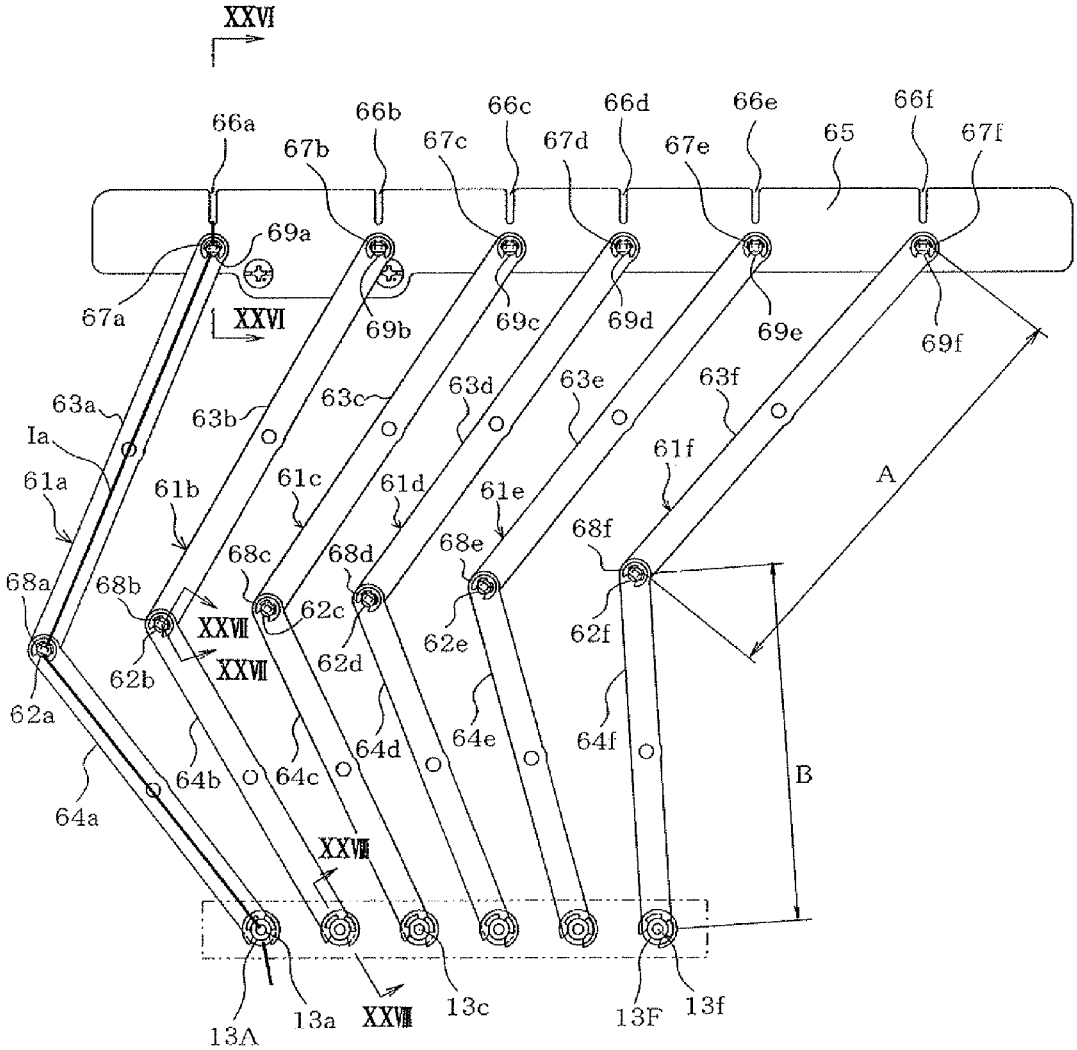
FIG. 24 is a view similar to FIG. 19, showing the multi-needle sewing machine of a third example.
Figure 25:
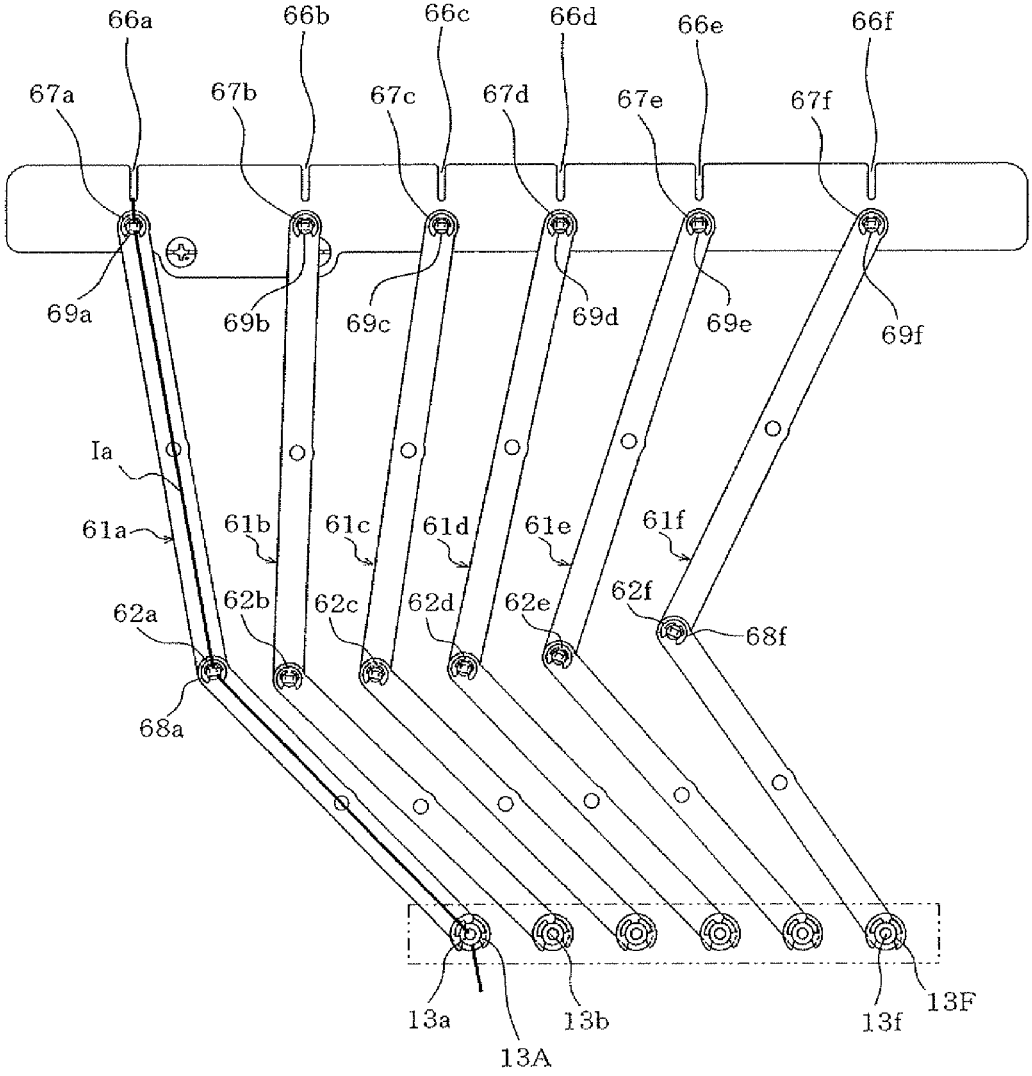
FIG. 25 is a view similar to FIG. 24, showing a different operating state of the intermediate thread guide portion moving mechanism.
Figure 26:
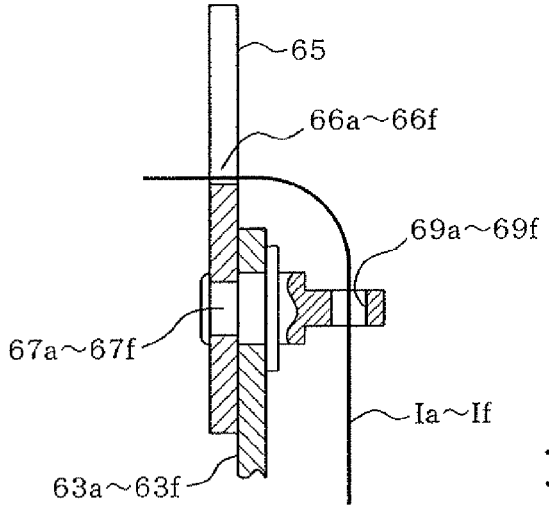
FIG. 26 is a sectional view taken along line XXVI-XXVI in FIG. 24.
Figure 27:
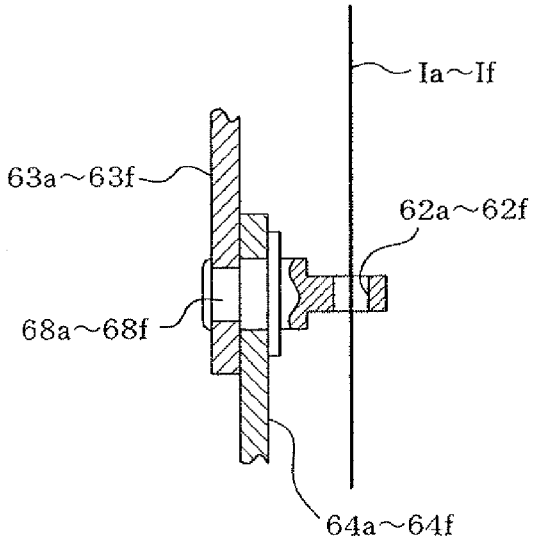
FIG. 27 is a sectional view taken along line XXVII-XXVII in FIG. 24.
Figure 28:
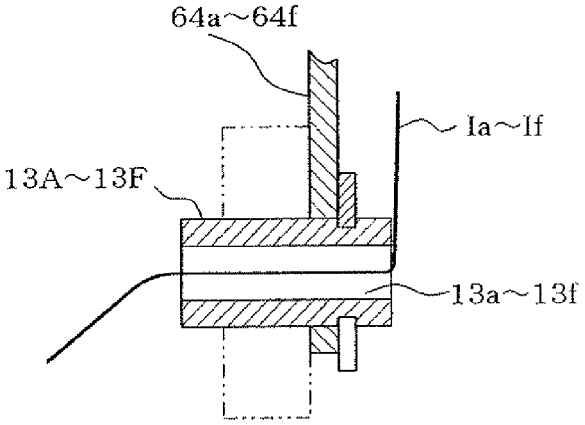
FIG. 28 is a sectional view taken along line XXVIII-XXVIII in FIG. 24.
Figure 29A:
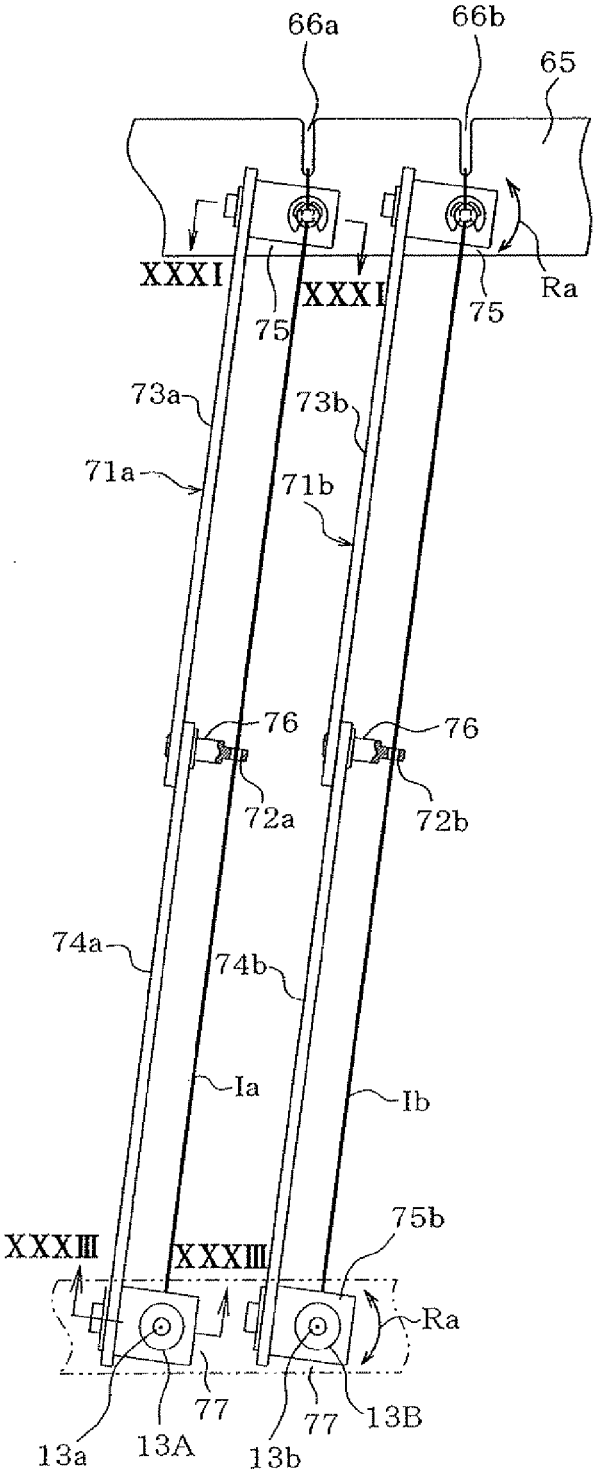
Figure 29B:
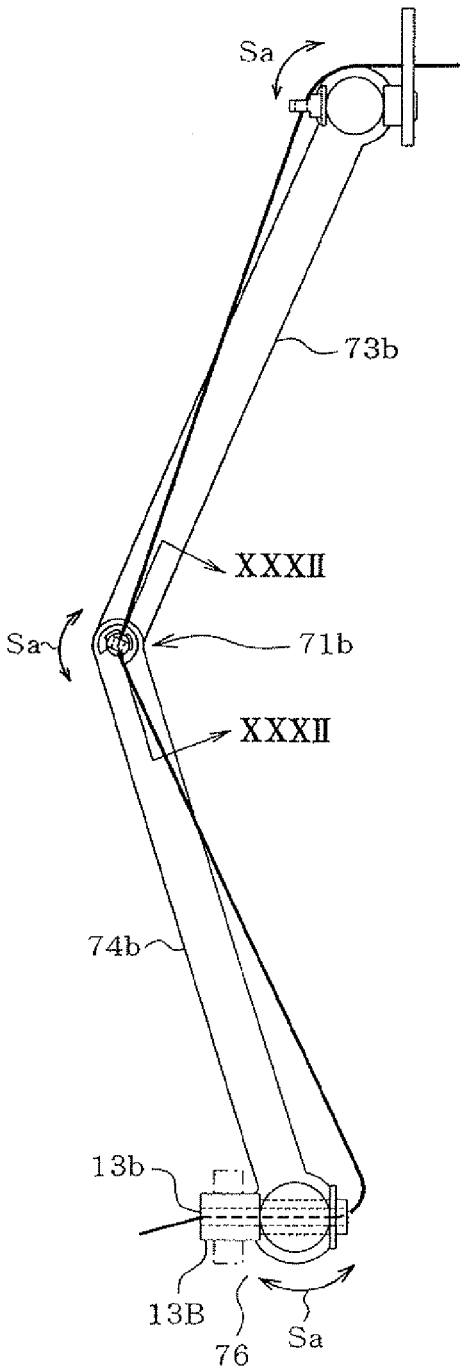
Figure 30A:
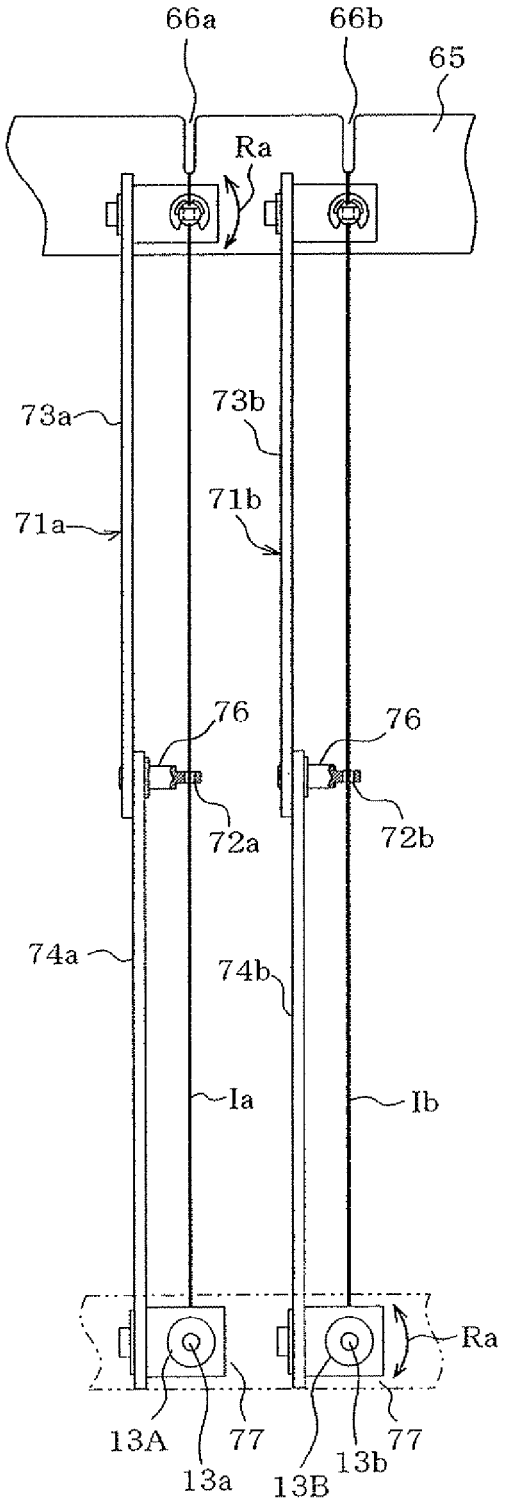
FIGS. 30A and 30B are similar to FIGS. 29A and 29B, showing the different operating states, respectively.
Figure 30B:
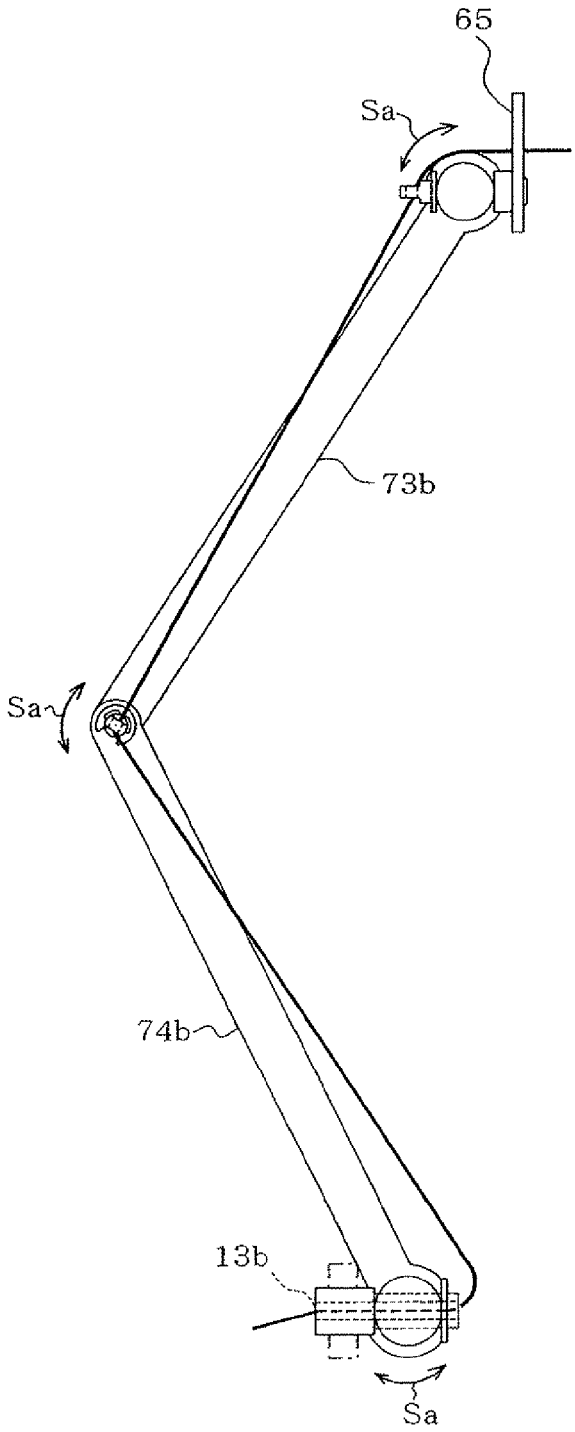

The pins 67*a*-67*f* are formed with threading holes 69*a* to 69*f* respectively as shown in FIG. 26. The pins 68*a*-68*f* serving as pivots for the first and second arm members 63*a*-63*f* and 64*a*-64*f* are formed with the foregoing intermediate thread guide portions 62*a* to 62*f* respectively as shown in FIG. 27. The threads Ia-If passed through machine frame side thread guide portions 66*a*-66*f* are guided through the threading holes 69*a*-69*f*, the intermediate thread guide portions 62*a*-62*f* and the thread entrances 13*a*-13*f* respectively. Although only one thread Ia is shown in FIGS. 24 and 25, it is assumed that six threads Ia-If would be provided. The machine frame side thread guide member 65 comprises a single plate member in the third example.

According to the third example, the intermediate thread guide portions 62*a*-62*f* are provided on the pins 68*a*-68*f* of the intermediate thread guide portion moving mechanisms 61*a*-61*f* respectively. The pins 68*a*-68*f* serve as the pivots for the first and second arm members 63*a*-63*f* and 64*a*-64*f* respectively. As the result of the foregoing construction, the intermediate thread guide portions 62*a*-62*f* are moved between the machine frame side guide portions 66*a*-66*f* and the thread entrances 13*a*-13*f* respectively while being spaced from one another. Consequently, the threads can be prevented from being entangled with one another, and an occurrence of thread entanglement can reliably be prevented. Moreover, the multi-needle sewing machine M is simple in construction and compact in size and does not necessitate a complicated work of passing the threads through the respective tubes.

Furthermore, the lengths of the threads Ia-If from the machine frame side thread guide portions 66*a*-66*f* to the thread entrances 13*a*-13*f* remain equal to addition (A+B) of the lengths of the first arm members 63*a*-63*f* and the lengths of the second arm members 64*a*-64*f* when the intermediate thread guide portions 62*a*-62*f* have been moved by the intermediate thread guide portion moving mechanisms 61*a*-61*f*, respectively. Consequently, the threads Ia-If can be prevented from being loosened.

Fourth Example

FIGS. 29 to 33 illustrate a fourth example. The fourth example differs from the third example in the following respects. The intermediate thread guide portion moving mechanisms 61*a*-61*f* are constructed so as to move the intermediate thread guide portions 62*a*-62*f* only in the right-left direction in the third example. In the fourth example, however, the intermediate thread guide portion moving mechanisms 71*a* to 71*f* (only two of the six mechanisms are shown) are constructed so as to move the intermediate thread guide portions 72*a* to 72*f* (only two of the six guide portions are shown) in the front-back direction as well as in the right-left direction. More specifically, six bidirectional rotation supports 75 are mounted on the machine frame side thread guide member 65. The first arm members 73*a*-73*f* have one ends which are mounted on the bidirectional rotation supports 75 so as to pivot in the directions of arrow Ra and arrows Sa, respectively. Pins 76 are mounted on one ends of the second arm members 74*a*-74*f* respectively. The first arm members 73*a*-73*f* have the other ends which are mounted on the pins 76 so as to pivot in the directions of arrows Ra and Sa, respectively. Six bidirectional rotation supports 77 are mounted on the cylindrical members 13A-13F (only two members shown) respectively. The second arm members 74*a*-74*f* have the other ends which are mounted on the supports 77 so as to pivot in the directions of arrows Ra and Sa.

Figure 31:
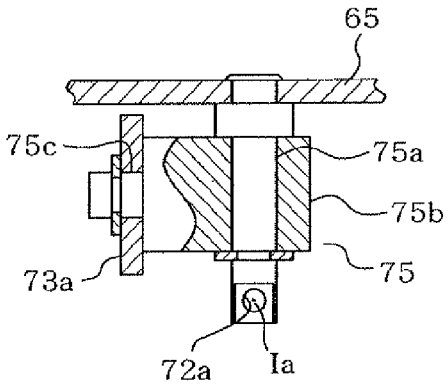
FIG. 31 is a sectional view taken along line XXXI-XXXI in FIG. 29A.
Figure 32:
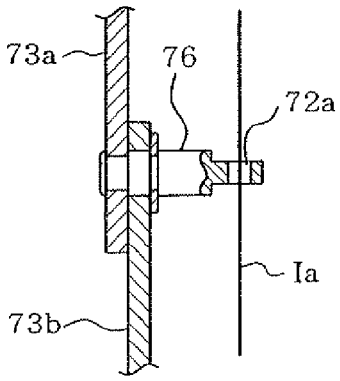
FIG. 32 is a sectional view taken along line XXXII-XXXII in FIG. 29B.
Figure 33:
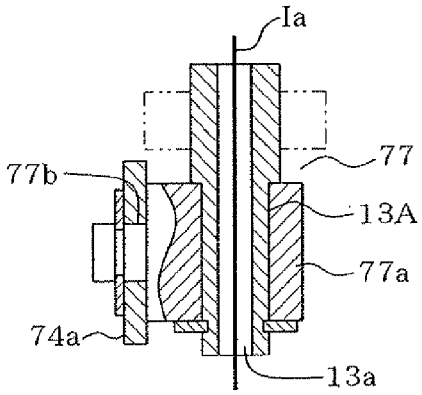
FIG. 33 is a sectional view taken along line XXXIII-XXXIII in FIG. 29A.

Each bidirectional rotation support 75 includes a pin 75*a* mounted on the machine frame side thread guide member 65, a support body 75*b* which is mounted on the pin 75*a* so as to be pivotable in the direction of arrow Ra, as shown in FIG. 31. The one ends of the first arm members 73*a*, 73*b* and so on are mounted on the bidirectional rotation support 75 so as to be pivotable in the direction of arrow Sa. The intermediate thread guide portions 72*a*, 72*b* and so on are formed on the pin 76 as shown in FIG. 32.

The bidirectional rotation supports 77 include support bodies 77*a* which are rotatably mounted around the cylindrical members 13A, 13B and so on, respectively. The bidirectional rotation supports 77 also include respective pins 77*b* mounted thereon. The other ends of the second arm members 74*a*, 74*b* and so on are mounted on the pins 77*b* so as to be pivotable in the direction of arrow Sa respectively. Consequently, the fourth example can achieve the same effect as the third example.

Fifth Example

Figure 34:
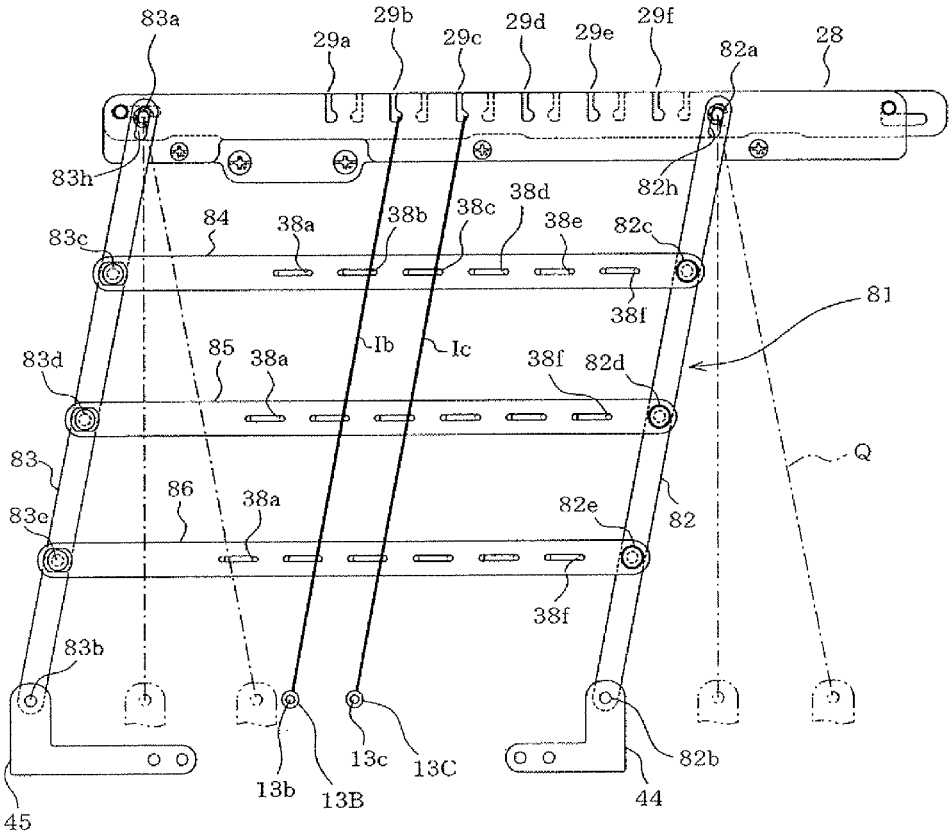
FIG. 34 is a front view of the intermediate thread guide portion moving mechanism, showing a fifth example.
Figure 35:
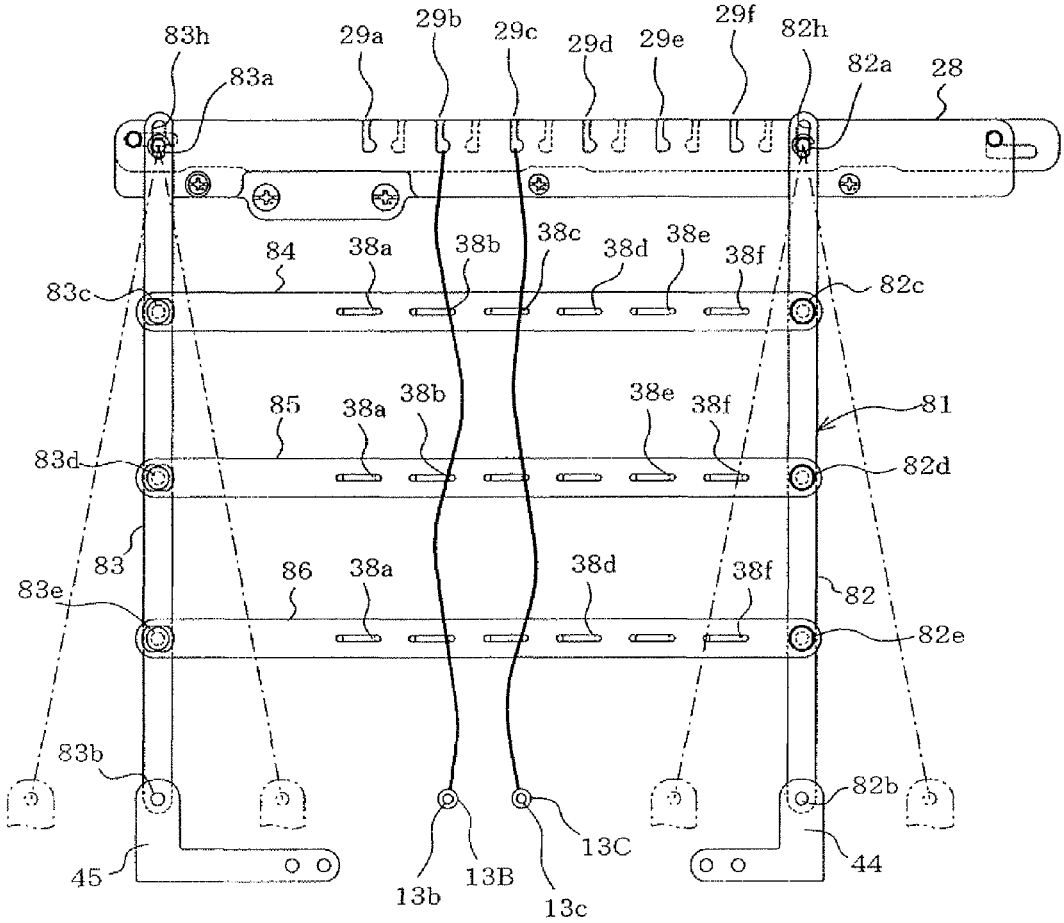
FIG. 35 is a view similar to FIG. 34, showing a different operating state.

FIGS. 34 and 35 illustrate a fifth example. The fifth example differs from the first example in the following. The intermediate thread guide portion moving mechanism 81 has a pair of support members 82 and 83 and a plurality of intermediate thread guide members 84, 85 and 86. The support member 82 has one end on which a pin 82*a* is mounted. The pin 82*a* is mounted on one of two ends of the machine frame side thread guide member 28 so that the one end of the support member 82 is pivotable. The support member 82 has the other end on which a pin 82*b* is mounted. The pin 82*b* is mounted on the support piece 44 so that the support member 82 is pivotable. The support member 82 has an elongate hole 82*h* in which the pin 82*a* is fitted so that the support member 82 is allowed to be moved upward and downward.

Furthermore, the other support member 83 has one of two ends on which a pin 83*a* is mounted. The other end of the machine frame side thread guide member 28 is mounted on the pin 83*a* so that the one end of the support member 83 is pivotable. A pin 83*b* is mounted on the other end of the support member 83. The pin 83*b* is further mounted on the support piece 45 so that the other end of the support member 83 is pivotable. The support member 83 has an elongate hole 83*h* in which the pin 83*a* is fitted so that the support member 83 is allowed to be moved upward and downward.

The intermediate thread guide members 84, 85 and 86 are parallel with one another and are pivotally mounted on the respective paired pins 82*c* and 83*c*, 82*d* and 83*d*, 82*e* and 83*e* between the paired support members 82 and 83. Each one of the intermediate thread guide members 84, 85 and 86 is provided with the plural intermediate thread guide portions 38*a*-38*f*.

The operating state of the intermediate thread guide portion moving mechanism 81 as shown in FIG. 34 differs from the operating state thereof as shown in FIG. 35. The intermediate thread guide portion moving mechanism 81 is operated with movement of the needle bar case 5. In this case, a leftmost movement position is shown by solid line in FIG. 34 regarding the swinging of the first support member 82. A rightmost movement position is shown by a dashed-dotted line Q in FIG. 34. Six threads Ia-If are assumed to be provided although only two threads Ib and Ic are shown in FIGS. 34 and 35.

According to the fifth example, the intermediate thread guide portion moving mechanism 81 includes the paired support members 82 and 83 and the intermediate thread guide members 84 and 85. The support members 82 and 83 are pivotally mounted between the machine frame side thread guide member 28 and the thread entrances 13*a*-13*f* of the needle bar case 5. The intermediate thread guide members 84 and 85 are mounted between the support members 82 and 83 so as to be in parallel to each other. Consequently, the threads Ia-If can be guided at the plural portions of each thread, whereupon the threads can reliably be prevented from being entangled with one another. Moreover, the multi-needle sewing machine M is simple in construction and compact in size and does not necessitate a complicated work of passing the threads through the respective tubes.

Sixth Example

Figure 36:
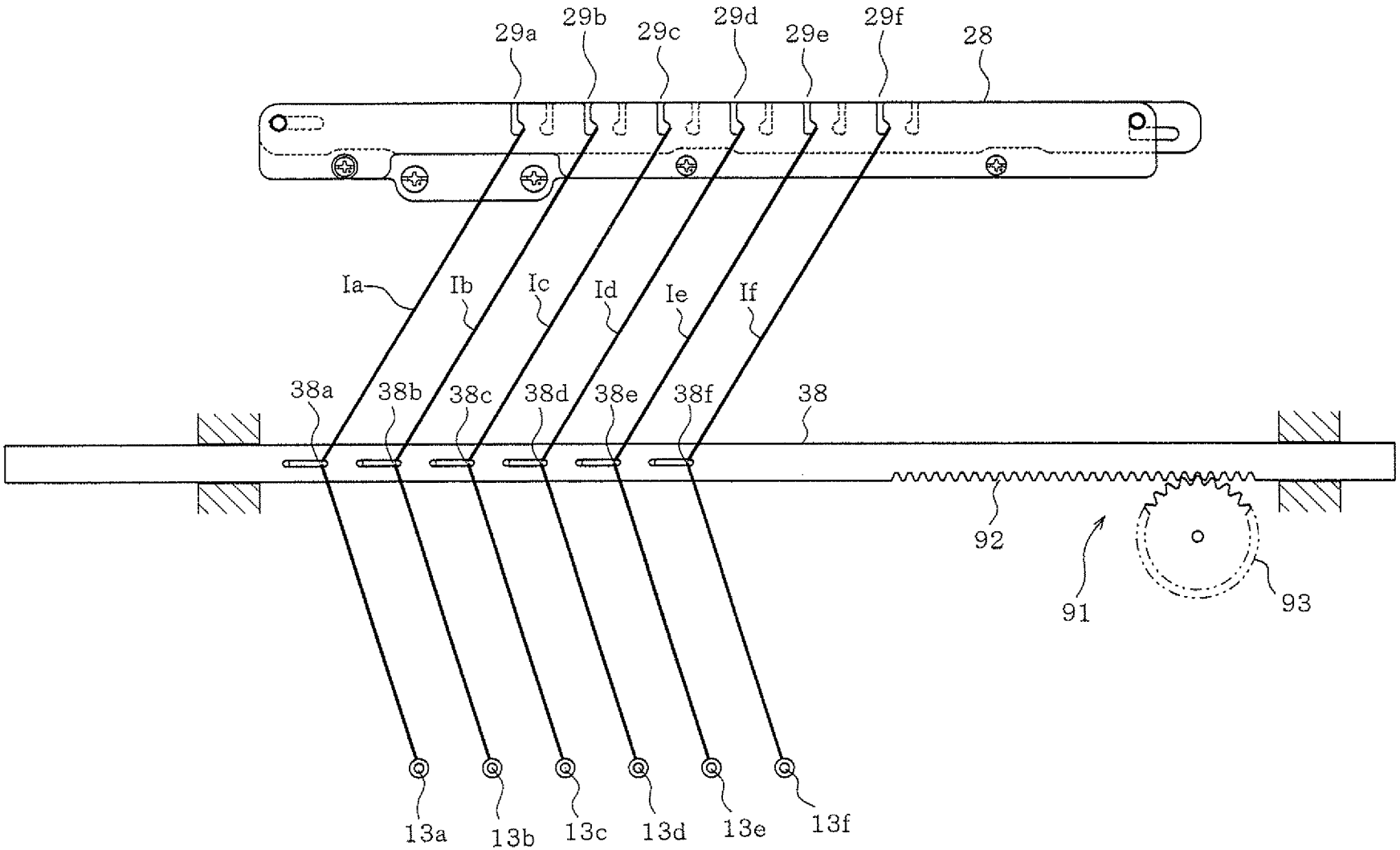
FIG. 36 is a front view of the intermediate thread guide portion moving mechanism, showing a sixth example.

FIG. 36 illustrates a sixth example. The sixth example differs from the first example in the construction of the intermediate thread guide portion moving mechanism 91. The intermediate thread guide portion moving mechanism 39 is constructed as the link mechanism in the first example and is operated in synchronization with the movement of the needle bar case 5. On the other hand, the intermediate thread guide portion moving mechanism 91 includes a rack 92, a pinion 93 and an electric motor (not shown) driving the pinion 93. The intermediate thread guide member 38 including the intermediate thread guide portions 38*a*-38*f* is moved in the right-left direction by the motor of the mechanism 91. In this case, the motor is driven so that the intermediate thread guide member 38 in the right-left direction in synchronization with the right-left movement of the needle bar case 5. Consequently, the sixth example can achieve the same effect as the first example.

The foregoing examples should not be restrictive and may be modified as follows. The machine frame side thread guide portions may be formed into through holes. The intermediate thread guide portions may be groove-like holes or through holes both formed in plates although the intermediate thread guide portions are made by bending the metal wire rods in the foregoing examples. The number of the needle bars may be changed and the number of the intermediate thread guide portions may also be changed according to the number of the needle bars.

The foregoing description and drawings are merely illustrative and are not to be construed in a limiting sense. Various changes and modifications will become apparent to those of ordinary skill in the art. All such changes and modifications are seen to fall within the scope as defined by the appended claims.

What is claimed is:

1. A multi-needle sewing machine comprising:

a plurality of needle bars having lower ends to which needles are configured to be attached, respectively;

a needle bar case which is configured to support the needles so that the needles are movable upward and downward;

a needle bar case moving mechanism which moves the needle bar case so that a predetermined one of the needle bars is moved to a needle position that is a sewing position;

a machine frame side thread guide member which is fixed to a machine frame and has a plurality of machine frame side thread guide portions which are arranged at predetermined intervals and are configured to guide threads drawn from a plurality of thread spools provided on the machine frame respectively;

a plurality of thread entrances which are defined in the needle bar case to introduce the threads guided by the machine frame side thread guide portions to the needle sides of the needle bars, respectively;

a plurality of intermediate thread guide portions which are provided between the machine frame side thread guide portions and the thread entrances so as to be movable respectively, the intermediate thread guide portions configured to guide intermediate portions of the threads extending from the machine frame side thread guide portions toward the thread entrances respectively; and an intermediate thread guide portion moving mechanism which moves the intermediate thread guide portions in accordance with movements of the thread entrances during a movement of the needle bar case such that the intermediate thread guide portions are moved by maintain that the intermediate thread guide portions are spaced from each other.

2. The multi-needle sewing machine according to claim 1, wherein:

the intermediate thread guide portions are provided in a single intermediate thread guide member so as to be aligned;

the intermediate thread guide portion moving mechanism includes a pair of first link members and a pair of second link members;

one of the paired first link members has one of two ends that is pivotally mounted on one of two ends of the machine frame side thread guide member and the other end that is pivotally mounted on one of two ends of the intermediate thread guide member;

the other first link member has one of two ends that is pivotally mounted on the other end of the machine frame side thread guide member and the other end that is pivotally mounted on the other end of the intermediate thread guide member;

the thread entrances are aligned, and one of the paired second link members has one of two ends that is pivotally mounted on a part of the needle bar case near one of two endmost thread entrances and the other end that is pivotally mounted on said one end of the intermediate thread guide member;

the other of the paired second link members has one of two ends that is pivotally mounted on another part of the needle bar case near the other endmost thread entrance and the other end that is pivotally mounted on said the other end of the intermediate thread guide member; and the paired first and second link members and the intermediate thread guide member constitute a parallel link mechanism.

3. The multi-needle sewing machine according to claim 1, wherein:

the plural intermediate thread guide portion moving mechanisms are provided for the respective intermediate thread guide portions, and the intermediate thread guide portions have respective first arm members and respective second arm members;

the first arm members have one ends that are pivotally mounted near the machine frame side thread guide portions respectively and the other ends that are pivotally mounted one of two ends of the second arm members, the second arm members having the other ends that are mounted on parts of the needle bar case near the thread entrances respectively; and the intermediate thread guide portions are provided in pivotally mounted portions of the first and second arm members respectively.

4. The multi-needle sewing machine according to claim 1, wherein:

the intermediate thread guide portion moving mechanism includes a pair of support members and a plurality of intermediate thread guide members;

the thread entrances are aligned, and one of the paired support members has one of two ends that is pivotally mounted on one of two ends of the machine frame side thread guide member and the other end that is pivotally mounted on a part of the needle bar case near one of two endmost thread entrances;

the other support member has one of two ends that is pivotally mounted on the other end of the machine frame side thread guide member and the other end that is pivotally mounted near the other endmost thread entrance;

the intermediate thread guide members are pivotally mounted between the support members so as to be parallel with each other; and the intermediate thread guide portions are provided in the intermediate thread guide members respectively.

5. The multi-needle sewing machine according to claim 1, wherein the machine frame side thread guide portions of the machine frame side thread guide member include curving units which curve the threads respectively.

6. The multi-needle sewing machine according to claim 5, wherein:

the machine frame side thread guide member includes three lengthy plate members stacked one upon another;

outer thread insertion holes are defined in both outside plate members and have locations substantially corresponding to each other, respectively;

the intermediate plate member has an inside thread insertion hole that is defined therein so as to be shifted from the outer thread insertion holes; and the outer thread insertion holes defined in the respective outer plate members and the inside thread insertion hole defined in the intermediate plate member constitute the respective curving units.

* * * * *